US008371932B2

(12) United States Patent
Gagner et al.

(10) Patent No.: US 8,371,932 B2
(45) Date of Patent: Feb. 12, 2013

(54) WAGER GAMING NETWORK WITH WIRELESS HOTSPOTS

(75) Inventors: Mark B. Gagner, West Chicago, IL (US); Shridhar P. Joshi, Naperville, IL (US); James M. Rasmussen, Chicago, IL (US); Richard T. Schwartz, Chicago, IL (US); Joseph Lane Spina, Las Vegas, NV (US)

(73) Assignee: WMS Gaming Inc., Waukegan, IL (US)

( * ) Notice: Subject to any disclaimer, the term of this patent is extended or adjusted under 35 U.S.C. 154(b) by 860 days.

(21) Appl. No.: 12/278,617

(22) PCT Filed: Feb. 7, 2007

(86) PCT No.: PCT/US2007/003341

§ 371 (c)(1),
(2), (4) Date: Jul. 7, 2009

(87) PCT Pub. No.: WO2007/092542

PCT Pub. Date: Aug. 16, 2007

(65) Prior Publication Data

US 2009/0298577 A1 Dec. 3, 2009

Related U.S. Application Data

(60) Provisional application No. 60/743,245, filed on Feb. 7, 2006, provisional application No. 60/744,645, filed on Apr. 11, 2006.

(51) Int. Cl.
*A63F 9/24* (2006.01)

(52) U.S. Cl. ..... 463/25; 463/42

(58) Field of Classification Search ..... 463/25
See application file for complete search history.

(56) References Cited

U.S. PATENT DOCUMENTS

| | | | | |
|---|---|---|---|---|
| 4,670,857 | A | 6/1987 | Rackman | |
| 5,116,055 | A | 5/1992 | Tracy | |
| 5,280,909 | A | 1/1994 | Tracy | |
| 5,344,199 | A * | 9/1994 | Carstens et al. | 463/17 |
| 5,638,448 | A | 6/1997 | Nguyen | |
| 5,823,879 | A | 10/1998 | Goldberg et al. | |
| 5,964,660 | A | 10/1999 | James et al. | |
| 5,971,271 | A | 10/1999 | Wynn et al. | |
| 6,035,397 | A | 3/2000 | Campinos et al. | |
| 6,058,389 | A | 5/2000 | Chandra et al. | |

(Continued)

FOREIGN PATENT DOCUMENTS

| | | | |
|---|---|---|---|
| WO | WO-97/38540 | A1 | 9/1997 |
| WO | WO-01/48713 | A1 | 7/2001 |

(Continued)

OTHER PUBLICATIONS

"U.S. Appl. No. 10/629,110, Non-Final Office Action mailed Jun. 3, 2008", 12 pgs.

(Continued)

*Primary Examiner* — Tramar Harper
(74) *Attorney, Agent, or Firm* — Schwegman Lundberg & Woessner, P.A.

(57) ABSTRACT

Embodiments of a wager gaming network that includes handheld wager gaming units and hotspots are described herein. In one embodiment, a method includes receiving, in a handheld wager gaming unit, a wager associated with a wagering game. The method can also include wirelessly connecting the handheld wager gaming unit to a wireless access point in a wager gaming network. The method can also include transmitting, via the wireless access point, information from the handheld wager gaming unit to a device on the wager gaming network.

18 Claims, 17 Drawing Sheets

U.S. PATENT DOCUMENTS 6,135,887 A 10/2000 Pease et al.
6,178,510 B1 1/2001 O'Connor et al.
6,183,366 B1 2/2001 Goldberg et al.
6,203,010 B1 3/2001 Jorasch
6,280,328 B1 8/2001 Holch et al.
6,319,125 B1 11/2001 Acres
6,358,149 B1 3/2002 Schneider
6,390,917 B1 5/2002 Walker et al.
6,468,155 B1 10/2002 Zucker et al.
6,508,709 B1 1/2003 Karmarkar
6,645,077 B2 * 11/2003 Rowe ..... 463/42
6,682,423 B2 1/2004 Brosnan et al.
6,773,344 B1 * 8/2004 Gabai et al. ..... 463/1
6,790,142 B2 9/2004 Okada et al.
6,830,515 B2 12/2004 Rowe
6,887,154 B1 5/2005 Luciano, Jr.
6,890,259 B2 5/2005 Breckner et al.
6,908,391 B2 6/2005 Gatto et al.
6,916,247 B2 7/2005 Gatto et al.
6,922,685 B2 7/2005 Greene et al.
6,935,958 B2 8/2005 Nelson
6,939,234 B2 9/2005 Beatty
RE38,812 E 10/2005 Acres et al.
6,997,803 B2 2/2006 LeMay et al.
7,025,674 B2 4/2006 Adams et al.
7,039,701 B2 5/2006 Wesley
7,043,641 B1 5/2006 Martinek
7,056,217 B1 6/2006 Pelkey et al.
7,117,349 B2 10/2006 Chu et al.
7,131,909 B2 11/2006 Rowe
7,159,007 B2 1/2007 Stawikowski
7,168,089 B2 1/2007 Nguyen et al.
7,185,342 B1 2/2007 Carrer et al.
7,186,181 B2 3/2007 Rowe
7,188,085 B2 3/2007 Pelletier
7,447,531 B2 * 11/2008 Eswaraiah ..... 455/575.8
8,137,192 B2 * 3/2012 Thomas ..... 463/31
2001/0014881 A1 8/2001 Drummond et al.
2001/0039210 A1 11/2001 St. Denis
2001/0044337 A1 * 11/2001 Rowe et al. ..... 463/29
2001/0044339 A1 11/2001 Cordero et al.
2002/0013174 A1 1/2002 Murata
2002/0143819 A1 10/2002 Han et al.
2002/0147049 A1 10/2002 Carter, Sr.
2002/0155891 A1 10/2002 Okada et al.
2002/0161868 A1 10/2002 Paul et al.
2002/0165023 A1 11/2002 Brosnan et al.
2002/0174160 A1 11/2002 Gatto et al.
2003/0004961 A1 1/2003 Slothouber et al.
2003/0061404 A1 3/2003 Atwal et al.
2003/0064771 A1 4/2003 Morrow et al.
2003/0064805 A1 * 4/2003 Wells ..... 463/39
2003/0065805 A1 4/2003 Barnes, Jr.
2003/0084342 A1 5/2003 Girard
2003/0087683 A1 5/2003 Gatto et al.
2003/0088421 A1 5/2003 Maes et al.
2003/0100369 A1 5/2003 Gatto et al.
2003/0100370 A1 5/2003 Gatto et al.
2003/0100371 A1 5/2003 Gatto et al.
2003/0100372 A1 5/2003 Gatto et al.
2003/0104865 A1 * 6/2003 Itkis et al. ..... 463/39
2003/0110242 A1 6/2003 Brown et al.
2003/0154216 A1 8/2003 Arnold et al.
2003/0188019 A1 10/2003 Wesley
2003/0208638 A1 11/2003 Abrams et al.
2003/0217139 A1 11/2003 Burbeck et al.
2003/0220835 A1 11/2003 Barnes, Jr.
2003/0228907 A1 12/2003 Gatto et al.
2003/0229900 A1 12/2003 Reisman
2004/0003039 A1 1/2004 Humphrey et al.
2004/0015608 A1 1/2004 Ellis et al.
2004/0031058 A1 2/2004 Reisman
2004/0048669 A1 3/2004 Rowe
2004/0063497 A1 4/2004 Gould
2004/0087367 A1 5/2004 Hendrickson
2004/0106454 A1 6/2004 Walker et al.
2004/0127277 A1 7/2004 Walker et al.
2004/0133485 A1 7/2004 Schoonmaker et al.
2004/0142744 A1 7/2004 Atkinson et al.
2004/0152511 A1 8/2004 Nicely et al.
2004/0158471 A1 8/2004 Davis et al.
2004/0180721 A1 9/2004 Rowe
2004/0193867 A1 9/2004 Zimmer et al.
2004/0198496 A1 10/2004 Gatto et al.
2004/0229684 A1 11/2004 Blackburn et al.
2004/0235563 A1 11/2004 Blackburn et al.
2004/0242328 A1 12/2004 Blackburn et al.
2004/0242329 A1 12/2004 Blackburn et al.
2004/0242330 A1 12/2004 Blackburn et al.
2004/0242331 A1 12/2004 Blackburn et al.
2004/0243848 A1 12/2004 Blackburn et al.
2004/0243849 A1 12/2004 Blackburn et al.
2004/0248645 A1 12/2004 Blackburn et al.
2004/0266532 A1 12/2004 Blackburn et al.
2005/0027871 A1 2/2005 Bradley et al.
2005/0032577 A1 2/2005 Blackburn et al.
2005/0054445 A1 3/2005 Gatto et al.
2005/0086286 A1 4/2005 Gatto et al.
2005/0088980 A1 4/2005 Olkkonen et al.
2005/0192099 A1 9/2005 Nguyen et al.
2005/0227768 A1 10/2005 Blackburn et al.
2005/0283522 A1 12/2005 Parkkinen et al.
2006/0035707 A1 * 2/2006 Nguyen et al. ..... 463/29
2006/0073887 A1 4/2006 Nguyen
2006/0142086 A1 6/2006 Blackburn et al.
2006/0143085 A1 6/2006 Adams et al.
2006/0205457 A1 9/2006 Blackburn et al.
2006/0242072 A1 10/2006 Peled et al.
2007/0015418 A1 * 1/2007 Faranda ..... 439/680
2007/0060381 A1 3/2007 Weiss
2007/0105613 A1 5/2007 Adams et al.
2007/0111787 A1 5/2007 Adams et al.
2007/0123332 A1 5/2007 Hishinuma et al.
2007/0123348 A1 5/2007 Nozaki
2007/0123349 A1 5/2007 Hishinuma et al.
2008/0054561 A1 * 3/2008 Canterbury et al. ..... 273/148 B
2009/0098925 A1 * 4/2009 Gagner et al. ..... 463/20
2010/0041464 A1 * 2/2010 Arezina et al. ..... 463/22

FOREIGN PATENT DOCUMENTS

WO WO-03/045516 A1 5/2003
WO WO-03/045515 A1 6/2003
WO WO-03/045517 A1 6/2003
WO WO-03/045518 A1 6/2003
WO WO-2004/004855 A1 1/2004
WO WO-2006/036536 A2 4/2006
WO WO-2007/092608 A2 8/2007
WO WO-2008/021079 A2 2/2008

OTHER PUBLICATIONS

"U.S. Appl. No. 10/629,110, Non Final Office Action mailed Jan. 24, 2007", 10 pgs.
"U.S. Appl. No. 10/629,110, Response filed Jul. 24, 2007 to Non Final Office Action mailed Jan. 24, 2007", 11 pgs.
"U.S. Appl. No. 10/629,110, Final Office Action Mailed Sep. 20, 2007", 10 pgs.
"U.S. Appl. No. 10/629,110, Response filed Feb. 20, 2008 to Final Office Action mailed Sep. 20, 2007", 11 pgs.
"U.S. Appl. No. 10/788,661, Final Office Action mailed Apr. 10, 2008", 21 pgs.
"U.S. Appl. No. 10/788,661, Response filed Feb. 28, 2008 to Restriction Requirement mailed Nov. 28, 2007", 11 pgs.
"U.S. Appl. No. 10/788,661, Response filed Sep. 17, 2007 to Non-Final Office Action mailed Jun. 15, 2007", 16 pgs.
"U.S. Appl. No. 10/788,661, Restriction Requirement mailed Nov. 28, 2007", 4 pgs.
"U.S. Appl. No. 10/788,661, Non-Final Office Action mailed Jun. 15, 2007", 11 pgs.
"U.S. Appl. No. 10/788,902, Final Office Action mailed May 17, 2007", 17 pgs.
"U.S. Appl. No. 10/788,902, Final Office Action mailed Aug. 6, 2008", 21 pgs.
"U.S. Appl. No. 10/788,902, Non-Final Office Action mailed Nov. 21, 2006", 19 pgs.

"U.S. Appl. No. 10/788,902, Response filed Feb. 21, 2007 to Non Final Office Action mailed Nov. 21, 2006", 15 pgs.
"U.S. Appl. No. 10/788,902, Response filed Aug. 17, 2007 to Final Office Action mailed May 17, 2007", 13 pgs.
"U.S. Appl. No. 10/788,902, Response filed Apr. 30, 2008 to Non-Final Office Action Oct. 30, 2007", 13 pgs.
"U.S. Appl. No. 10/788,902, Non-Final Office Action mailed Oct. 30, 2007", 18 pgs.
"U.S. Appl. No. 10/788,903, Non Final Office Action mailed Jan. 3, 2007", 21 pgs.
"U.S. Appl. No. 10/788,903, Non Final Office Action mailed Jun. 28, 2007", 16 pgs.
"U.S. Appl. No. 10/788,903, Response filed Apr. 9, 2007 to Non Final Office Action mailed Jan. 3, 2007", 22 pgs.
"U.S. Appl. No. 10/788,903, Final Office Action mailed Dec. 31, 2007", 16 pgs.
"U.S. Appl. No. 10/788,903, Response filed Sep. 28, 2007 to Non-Final Office Action mailed Jun. 28, 2007", 13 pgs.
"U.S. Appl. No. 10/789,957, Non Final Office Action mailed May 16, 2007", 27 pgs.
"U.S. Appl. No. 10/789,957, Response filed Aug. 16, 2007 to Non Final Office Action mailed May 16, 2007", 17 pgs.
"U.S. Appl. No. 10/794,422, Response filed Nov. 19, 2007 to Non-Final Office Action mailed Jul. 18, 2007", 11 pgs.
"U.S. Appl. No. 10/794,422, Response filed Jul. 15, 2008 to Final Office Action mailed Feb. 15, 2008", 10 pgs.
"U.S. Appl. No. 10/794,422, Non Final Office Action Mailed Jul. 18, 2007", 9 pgs.
"U.S. Appl. No. 10/794,422, Final Office Action mailed Feb. 15, 2008", 11 pgs.
"U.S. Appl. No. 10/794,423, Response filed Nov. 20, 2007 to Non-Final Office Action mailed Jul. 20, 2007", 12 pgs.
"U.S. Appl. No. 10/794,423, Response filed Jul. 15, 2008 to Final Office Action mailed Feb. 15, 2008", 12 pgs.
"U.S. Appl. No. 10/794,423 Non-Final Office Action Mailed Jul. 20, 2007", 10 pgs.
"U.S. Appl. No. 10/794,423, Final Office Action mailed Feb. 15, 2008", 7 Pgs.
"U.S. Appl. No. 10/796,562, Non-Final Office Action mailed Nov. 27, 2007", 7 pgs.
"U.S. Appl. No. 10/796,562, Response filed May 27, 2008 to Non Final Office Action mailed Nov. 27, 2007", 10 pgs.
"U.S. Appl. No. 10/802,537, Non-Final Office Action mailed May 23, 2008", 25 pgs.
"U.S. Appl. No. 10/802,699, Non-Final Office Action mailed Sep. 27, 2007", 7 pgs.
"U.S. Appl. No. 10/802,699, Response to Non Final Office Action mailed Sep. 27, 2007", 9 pgs.
"U.S. Appl. No. 10/802,699, Final Office Action mailed Jul. 9, 2008", 12 Pgs.
"U.S. Appl. No. 10/802,700, Response to Non-Final Office Action filed Mar. 12, 2008", 8 pgs.
"U.S. Appl. No. 10/802,700, Non-Final Office Action mailed Sep. 12, 2007", 7 pgs.
"U.S. Appl. No. 10/802,700, Final Office Action mailed Jul. 9, 2008", 13 pgs.
"U.S. Appl. No. 10/802,701, Final Office Action mailed Aug. 22, 2008", 11 pgs.
"U.S. Appl. No. 10/802,701, Response filed Oct. 25, 2007 to Final Office Action mailed Jul. 25, 2007", 9 pgs.
"U.S. Appl. No. 10/802,701, Response filed May 12, 2008 to Non Final Office Action mailed Feb. 11, 2008", 10 pgs.
"U.S. Appl. No. 10/802,701, Final Office Action Mailed Jul. 25, 2007", 8 pgs.
"U.S. Appl. No. 10/802,701, Non-Final Office Action mailed Jan. 3, 2007", 9 pgs.
"U.S. Appl. No. 10/802,701, Response filed May 3, 2007 to Non-Final Office Action mailed Jan. 3, 2007", 12 pgs.
"U.S. Appl. No. 10/802,701, Non-Final Office Action mailed Feb. 11, 2008", 13 pgs.
"U.S. Appl. No. 10/813,653 Non-Final Office Action mailed Nov. 7, 2007", 13 pgs.
"U.S. Appl. No. 10/813,653, Response filed Sep. 10, 2007 to Final Office Action mailed Jun. 8, 2007", 10 pgs.
"U.S. Appl. No. 10/813,653, Final Office Action mailed Jun. 8, 2007", 11 pgs.
"U.S. Appl. No. 10/813,653, Non-Final Office Action mailed Nov. 13, 2006", 10 pgs.
"U.S. Appl. No. 10/813,653 Response filed Feb. 13, 2007 to Non Final Office Action mailed Nov. 13, 2006", 13 pgs.
"U.S. Appl. No. 10/813,653, Response filed May 7, 2008 to Non-Final Office Action mailed Nov. 7, 2007", 11 pgs.
"U.S. Appl. No. 10/824,780, Final Office Action mailed May 30, 2008", 14 pgs.
"U.S. Appl. No. 10/824,780, Non-Final Office Action mailed May 17, 2007", 12 pgs.
"U.S. Appl. No. 10/824,780, Response filed Aug. 6, 2007 to Non Final Office Action mailed May 17, 2007", 17 pgs.
"U.S. Appl. No. 10/824,930, Response filed Jul. 24, 2008 to Final Office Action mailed Mar. 24, 2008", 15 pgs.
"U.S. Appl. No. 10/824,930, Final Office Action mailed Mar. 24, 2008", 17 pgs.
"U.S. Appl. No. 10/824,930, Non-Final Office Action Mailed Aug. 10, 2007", 13 pgs.
"U.S. Appl. No. 10/824,930, Response filed Dec. 10, 2007 to Office Action Mailed Aug. 10, 2007", 15 pgs.
"U.S. Appl. No. 10/824,945, Response filed Aug. 26, 2008 to Non-Final Office Action mailed Feb. 26, 2008", 15 pgs.
"U.S. Appl. No. 10/824,945, Non-Final Office Action mailed Feb. 26, 2008", 15 pgs.
"U.S. Appl. No. 11/068,065, Final Office Action mailed Jan. 9, 2008", 15 pgs.
"U.S. Appl. No. 11/068,065, Non-Final Office Action mailed Apr. 22, 2008", 16 pgs.
"U.S. Appl. No. 11/068,065, Response filed Oct. 22, 2007 to Non-Final Office Action mailed May 8, 2007", 11 pgs.
"U.S. Appl. No. 11/068,065, Non Final Office Action mailed Apr. 20, 2007", 13 pgs.
"U.S. Appl. No. 11/068,065, Non Final Office Action mailed May 8, 2007", 13 pgs.
"U.S. Appl. No. 11/068,065, Response filed Apr. 9, 2008 to Final Office Action mailed Jan. 9, 2008.", 11 pgs.
"U.S. Appl. No. 11/143,874, Non-Final Office Action mailed May 13, 2008", 13 pgs.
"U.S. Appl. No. 11/143,874, Response filed Aug. 13, 2008 to Non Final Office Action mailed May 13, 2008", 12 pgs.
"U.S. Appl. No. 11/143,874, Response filed Aug. 24, 2007 to Final Office Action mailed Apr. 24, 2007", 9 pgs.
"U.S. Appl. No. 11/143,874, Response filed Feb. 12, 2008 to Non-Final Office Action Sep. 17, 2007", 12 pgs.
"U.S. Appl. No. 11/143,874, Non-Final Office Action mailed Sep. 17, 2007", 10 pgs.
"UDDI: FAQs", [online]. [archived Oct. 25, 2001]. Retrieved from the Internet: <URL: http://web.archive.org/web/20011024231452/http://uddi.org/faqs.html>, (2001), 10 pgs.
"International Application Serial No. PCT/US07/03341, International Search Report mailed Dec. 6, 2007", 2 pgs.
"International Application Serial No. PCT/US07/03341, Written Opinion mailed Dec. 6, 2007", 4 pgs.
"UDDI: Frequently Asked Questions", [online], © 2007, Microsoft Corporation, [retrieved Oct. 30, 2007]. Retrieved from the Internet: <URL: http://www.microsoft.com/windowsserver2003/evaluation/overview/dotnet/uddifaq.mspx>, 7 pgs.
"UDDI: Frequently Asked Questions", [online], © 2007, Microsoft Corporation, [retrieved Feb. 5, 2008]. Retrieved from the Internet: <URL: http://www.microsoft.com/windowsserver2004/evaluation/overview/dotnet/uddifaq.mspx>, 7 pgs.
Gottschalk, K., et al., "Introduction to Web Services Architecture", *IBM Systems Journal*;41(2), (2002), 170-177.
Ogbuji, U., "Using WSDL in SOAP Applications", *IBM developerWorks*: [online]. [archived Aug. 20, 2001]. Retrieved from the Internet: <URL: http://web.archive.org/web/20010820205450/www-106.ibm.com/developerworks/webservices/library/ws-soap/index.html?dwzone=webservices>, (Nov. 2000), 5 pgs.

Prescod, P., "Second Generation Web Serviced", [online]. © 1998-2006, O'Reilly Media, Inc. Retrieved from the Internet: <URL: http://webservices.xml.com/lpt/a/915, (Feb. 6, 2002), 7 pgs.
Sabbouh, M., et al., "World Wide Web Consortium", *Workshop on Web Services*, (Apr. 11-12, 2001, San Jose, CA), (2001), 3 pgs.
Vasudevan, V., "A Web Services Primer", [online]. © 1998-2006, O'Reilly Media, Inc. Retrieved from the Internet: <URL: http://www.xml.com/lpt/a/760>, (Apr. 4, 2001), 10 pgs.
Java Web Services, Jewell, (Mar. 2002,), 1-43 pgs.
"U.S. Appl. No. 10/802,537, Examiner Interview Summary mailed Oct. 24, 2008", 4 pgs.
"U.S. Appl. No. 10/802,537, Final Office Action mailed Feb. 5, 2009", 23 pgs.
"U.S. Appl. No. 10/802,537, Non Final Office Action mailed Mar. 29, 2011", 15 pgs.
"U.S. Appl. No. 10/802,537, Non-Final Office Action mailed Mar. 17, 2010", 25 pgs.
"U.S. Appl. No. 10/802,537, Response filed Oct. 23, 2008 to Non Final Office Action mailed May 23, 2008", 12 pgs.
"U.S. Appl. No. 10/802,537, Response filed Dec. 7, 2009 to Final Office Action mailed Feb. 5, 2009", 10 pgs.
"International Application Serial No. PCT/US2007/003341, International Preliminary Examination Report mailed Jan. 13, 2009", 13 pgs.
"Web Services Architecture", W3C Working Draft, [online]. [retrieved Jan. 21, 2009]. Retrieved from the Internet: <URL: http://www.w3.org/TR/2002/wd-WS-arch-20021114/>, (Nov. 14, 2002), 1-78.
"U.S. Appl. No. 10/802,537, Response filed Jan. 18, 2011 to Non Final Office Action mailed Mar. 17, 2010", 9 pgs.

* cited by examiner

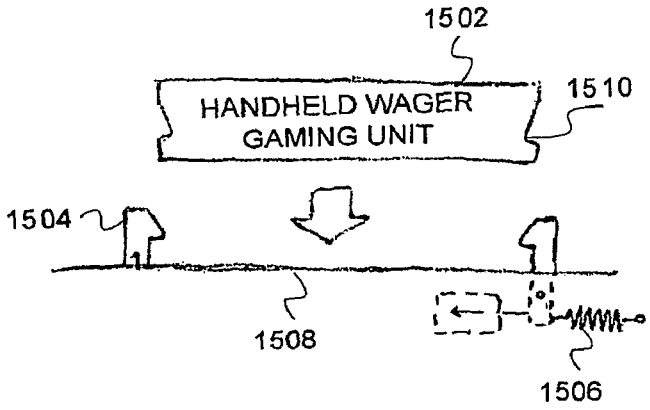
FIG. 15A
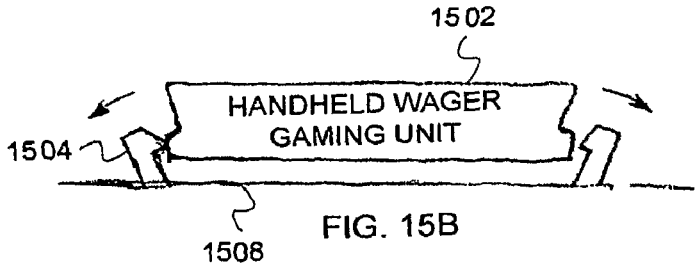
FIG. 15B
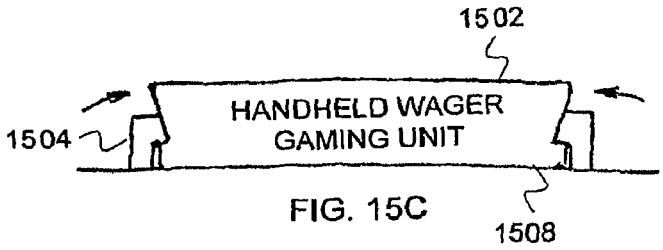
FIG. 15C
FIG. 15

WAGER GAMING NETWORK WITH WIRELESS HOTSPOTS

RELATED APPLICATIONS

This patent application is a U.S. National Stage Filing under 35 U.S.C. 371 from International Patent Application Serial No. PCT/US2007/003341, filed Feb. 7, 2007, and published on Aug. 16, 2007 as WO 2007/092542 A2 and republished as WO 2007/092542 A3, which claims the priority benefit of U.S. Provisional Patent Application Ser. No. 60/743,245 filed Feb. 7, 2006 and entitled "SYSTEM AND METHOD FOR CREATING A WAGER GAMING WIRELESS HOTSPOT", and of U.S. Provisional Patent Application Ser. No. 60/744,645 filed Apr. 11, 2006 and entitled "WAGER GAMING NETWORK WITH WIRELESS HOTSPOTS", the contents of which are incorporated herein by reference in their entirety.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2006, 2007, WMS Gaming, Inc.

FIELD

Embodiments of the inventive subject matter relate generally to wager gaming networks, and more particularly to wager gaming networks including wireless hotspots.

BACKGROUND

Wager gaming machines, such as slot machines, video poker machines, and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are most likely attracted to the most entertaining and exciting of the machines. Consequently, shrewd operators strive to employ the most entertaining and exciting machines available because such machines attract frequent play and increase profitability for the operator. In the competitive wager gaming machine industry, there is a continuing need for manufacturers to produce new game types or to enhance entertainment and excitement associated with existing wager gaming machines.

BRIEF DESCRIPTION OF THE FIGURES

The present invention is illustrated by way of example and not limitation in the Figures of the accompanying drawings in which:

FIG. 15A is a side view of a latching mechanism for securing a handheld wager gaming unit to a wager gaming station, according to example embodiments of the invention;

FIG. 15B is a side view of a handheld wager gaming unit mating with a wager gaming station's latches, according to example embodiments of the invention;

FIG. 15C is side view of a handheld wager gaming unit mated to a wager gaming station's latches, according to example embodiments of the invention;

DESCRIPTION OF THE EMBODIMENTS

Systems and methods for a wager gaming network with hotspots are described herein. This description of the embodiments is divided into six sections. The first section provides an introduction to embodiments of the invention. The second section describes an example operating environment, the third section describes example operations performed by embodiments of the invention, and the fourth section describes security features of some embodiments. The fifth section describes an example wagering game machine, whereas the sixth section presents some general comments.

Introduction

Figure 1:
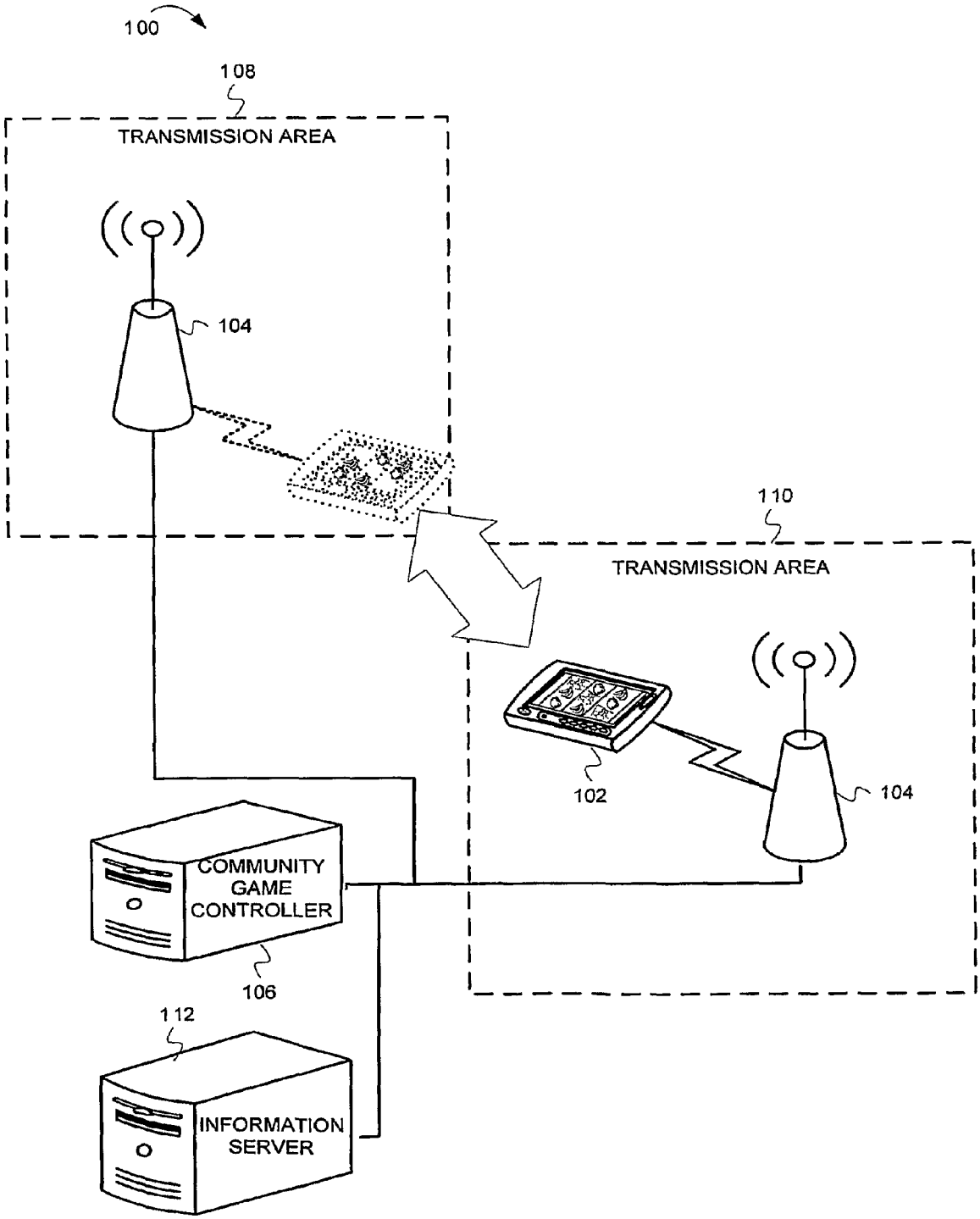
FIG. 1 is a block diagram illustrating hotspots in a wager gaming network, according to embodiments of the invention.

This section introduces embodiments of a wager gaming network that includes handheld wager gaming units and hotspots. In one embodiment, handheld wager gaming units can connect to a wager gaming network through one or more wireless access points. Using the wireless access points, the handheld wager gaming units can wirelessly communicate with various wager gaming network devices. Consequently, players can wirelessly participate in community games and obtain online information (e.g., show times, casino maps, etc.). Some embodiments enable players to roam about wager gaming environments, as the handheld wager gaming units can include logic for seamlessly switching between hotspots. Therefore, embodiments of the wager gaming network can facilitate mobile wager gaming and wireless access to network-based games and services. FIG. 1 describes these features in more detail.

FIG. 1 is a block diagram illustrating hotspots in a wager gaming network, according to embodiments of the invention. As shown in FIG. 1, the wager gaming network 100 includes a handheld wager gaming unit 102, wireless access points 104, community game controller 106, and information server 112. In one embodiment, the handheld wager gaming unit 102 can conduct wagering games (e.g., video slots, poker, keno, bingo, roulette, blackjack, etc.) while moving about a casino floor. In addition to conducting wagering games, the handheld wager gaming unit 102 can wirelessly connect to the wager gaming network 100 through the wireless access points 104. While connected, the handheld wager gaming unit 102 can participate in community games and receive online information. The handheld wager gaming unit 102 may also be used for non-gaming purposes such as for entertainment or instruction, especially when the gaming unit 102 is located in areas where wager-based gaming is prohibited. As an instruction or teaching aid, the gaming unit 102 may display a tutorial for educating novice gamblers on how to use the gaming unit 102 itself and how to play wagering games. Such tutorials may alternatively be presented on a display at the wager gaming stations 216 (see FIG. 2) from which the gaming units 102 are checked out.

In order to provide wireless connectivity in multiple locations, the wager gaming network 100 includes multiple wireless access points 104. Each wireless access point 104 provides wireless connectivity for a particular transmission area (see transmission areas 108 and 110). In one embodiment, the handheld wager gaming unit 102 can seamlessly move between transmission areas 108 and 110 while maintaining (or appearing to maintain) connectivity to the wager gaming network 100. As shown in FIG. 1, the handheld wager gaming unit 102 can move from transmission area 110 to transmission area 108, seamlessly switching its connection between the wireless access points 104. The handheld wager gaming unit 102 may switch between wireless access points when it detects low signal strength.

In the following sections, this description will describe these and other embodiments of the invention in greater detail.

Example Operating Environment

This section describes an example operating environment in which embodiments of the invention can be practiced. This section will first present an example wager gaming network and then an example machine architecture.

Example Network

Figure 2:
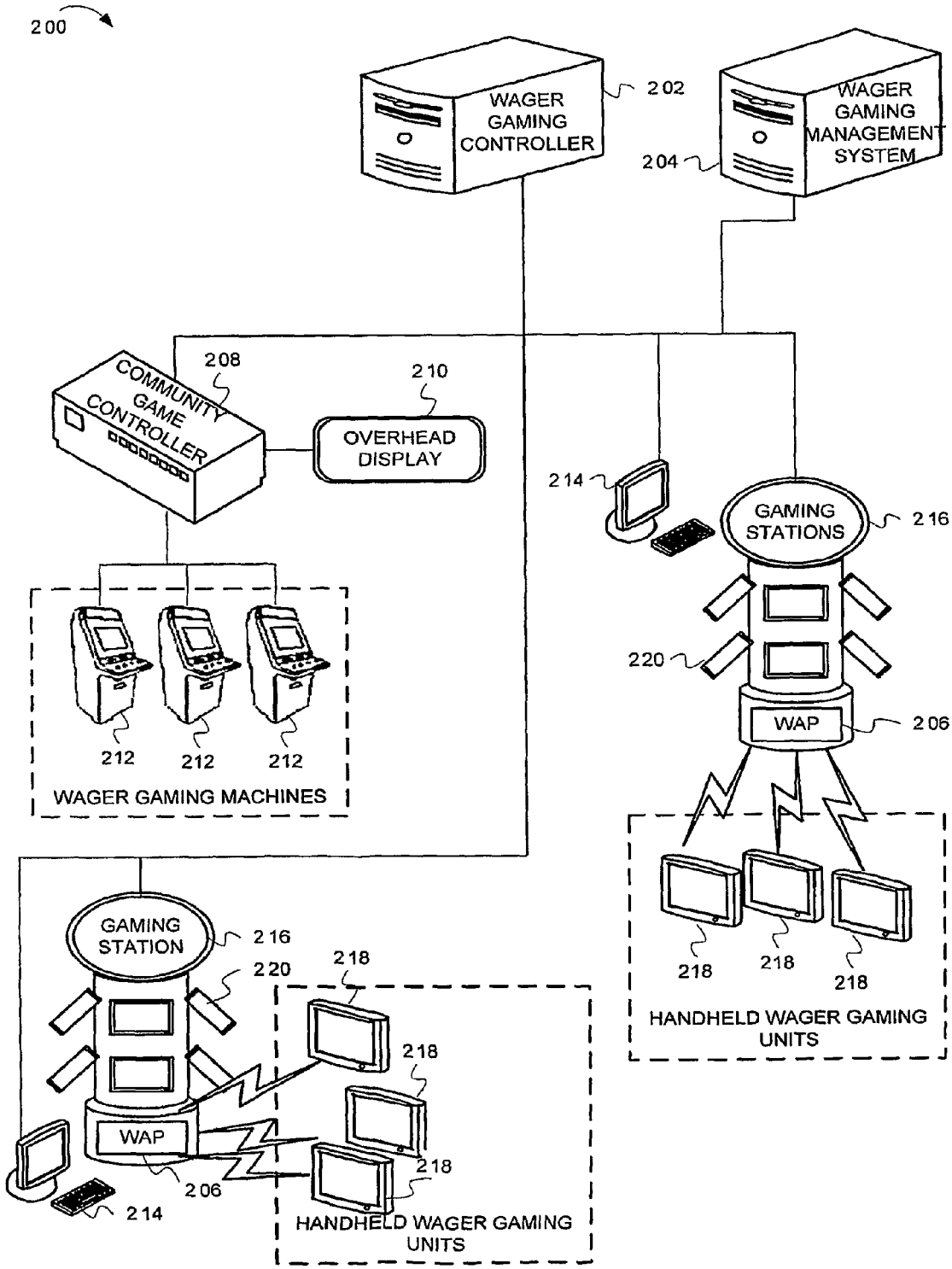
FIG. 2 is a block diagram illustrating a wager gaming network with hotspots, according to embodiments of the invention.

FIG. 2 is a block diagram illustrating a wager gaming network with hotspots, according to embodiments of the invention. As shown in FIG. 2, the wager gaming network 200 includes a wager gaming controller 202 connected to a wager gaming management system 204 and workstations 214. The wager gaming controller 202 is also connected to a community game controller 208, which is connected to an overhead display 210 and a plurality of wager gaming machines 212. The wager gaming network 200 also includes wager gaming stations 216 and handheld wager gaming units 218.

Some of the wager gaming stations 216 are suited for installation at fixed locations, whereas others are suited for mobility. For example, the wager gaming stations 216 can include wheels, motors, etc. (not shown) for moving to different locations about a casino (e.g., near a bar).

The wager gaming stations 216 can include wireless access points 206 that enable the handheld wager gaming units 218 to wirelessly communicate with the wager gaming network devices (e.g., community game controller 208). In one embodiment, because the wagering game stations 216 include the wireless access points 206, the wagering game stations 216 can define a space in which the handheld wager gaming units 218 can present wagering games. The wager gaming stations 216 can be repositioned about a casino to define different wager gaming areas.

In one embodiment, the wireless access points 206 can be separate from the wager gaming stations 216. In one embodiment, where the wireless access points are not included in the wager gaming stations 216, the wireless access points 216 are hotspots for the handheld wager gaming units 218. In another embodiment, if the wireless access points 206 are included in the wager gaming stations 216, the wager gaming stations 218 form wireless hot spots for the handheld wager gaming units 218. In one embodiment, the wireless access points 206 can employ the 802.11g, 802.11b, or other suitable wireless communication protocols. In one embodiment, the wireless access points 206 can be Linksys WAP54G Wireless-G Access Points, available from Linksys, a division of Cisco Systems of Santa Clara, Calif. In another embodiment, the wireless access points 206 can include any suitable wireless access point technology.

The wager gaming stations 216 can contain the handheld wager gaming units 218. In one embodiment, the wager gaming stations 216 also include receptacles 220 for securely storing, recharging, sanitizing, and updating the handheld wager gaming units 218. In one embodiment, the wager gaming stations 216 can include any of the wager gaming network components, such as the wager gaming controller 202. Wager gaming stations will be described in greater detail below.

The handheld wager gaming units 218 can present wagering games, participate in community games, and connect with wager gaming network devices to receive information and services. Handheld wager gaming units will be described in greater detail below.

The wager gaming controller 202 can store and disseminate software updates to the handheld wager gaming units 218 when they are docked in the receptacles 220. In one embodiment, these updates can be disseminated through wired or wireless links. The software updates can include configuration information (e.g., device drivers, wagering game code, etc.) and wager gaming content. The wager gaming content can include audio and video content (e.g., new bonus events, wagering game episodes), pay tables, etc. Additionally, the wager gaming controller 202 can perform operations associated with presenting wagering games on the handheld wager gaming units 218 and/or the wagering game 212. In one embodiment, the wager gaming controller 202 can be stored on a casino floor or in a segregated and secure area/room.

The wager gaming management system 204 can record information about the handheld wager gaming units 218, such as payout frequencies, payout amounts, games played, etc. The workstations 214 provide an administrator interface to the wager gaming controller 202, and wager gaming management system 204. Thus, system administrators can use the workstations 214 to configure and/or access information stored in the wager gaming controller 202, the wager gaming management system 204, and the wager gaming units 218.

This description continues with a discussion of wireless communications and an example handheld wager gaming unit architecture.

Wireless Communications

In some embodiments, wireless access points 104 and 206 and handheld wager gaming units 102 and 218 may communicate orthogonal frequency division multiplexed (OFDM) communication signals over a multicarrier communication channel. The multicarrier communication channel can be within a predetermined frequency spectrum and can comprise a plurality of orthogonal subcarriers. In some embodiments, the multicarrier signals can be defined by closely spaced OFDM subcarriers. Each subcarrier can have a null at substantially a center frequency of the other subcarriers and/or each subcarrier can have an integer number of cycles within a symbol period, although the scope of the invention is not limited in this respect. In some embodiments, wireless access points 104 and 206 and handheld wager gaming units 102 and 218 can communicate in accordance with a broadband multiple access technique, such as orthogonal frequency division multiple access (OFDMA), although the scope of the invention is not limited in this respect. In some embodiments, wireless access points 104 and 206 and handheld wager gaming units 102 and 218 can communicate using spread-spectrum signals, although the scope of the invention is not limited in this respect.

In some embodiments, any of wireless access points 104 and 206 can be part of a communication station, such as wireless local area network (WLAN) communication station including a Wireless Fidelity (WiFi) communication station, or a WLAN access point (AP). In these embodiments, handheld wager gaming units 102 and 218 can be part of a mobile station, such as WLAN mobile station or a WiFi mobile station, although the scope of the invention is not limited in this respect.

In some other embodiments, any of wireless access points 104 and 206 can be part of a broadband wireless access (BWA) network communication station, such as a Worldwide Interoperability for Microwave Access (WiMax) communication station, although the scope of the invention is not limited in this respect as wireless access points 104 and 206 can be part of almost any wireless communication devices. In these embodiments, handheld wager gaming units 102 and 218 can be part of a BWA network communication station, such as a WiMax communication station, although the scope of the invention is not limited in this respect.

In some embodiments, any of handheld wager gaming units 102 and 218 can part of a portable wireless communication device, such as a personal digital assistant (PDA), a laptop or portable computer with wireless communication capability, a web tablet, a wireless telephone, a wireless headset, a pager, an instant messaging device, a digital camera, a television, a medical device (e.g., a heart rate monitor, a blood pressure monitor, etc.), or other device that can receive and/or transmit information wirelessly.

In some embodiments, the frequency spectrums for the communication signals transmitted and received by wireless access points 104 and 206 and handheld wager gaming units 102 and 218 can comprise either a 5 gigahertz (GHz) frequency spectrum or a 2.4 GHz frequency spectrum. In these embodiments, the 5 GHz frequency spectrum can include frequencies ranging from approximately 4.9 to 5.9 GHz, and the 2.4 GHz spectrum can include frequencies ranging from approximately 2.3 to 2.5 GHz, although the scope of the invention is not limited in this respect, as other frequency spectrums are also equally suitable. In some BWA network embodiments, the frequency spectrum for the communication signals can comprise frequencies between 2 and 11 GHz, although the scope of the invention is not limited in this respect.

In some embodiments, wireless access points 104 and 206 and handheld wager gaming units 102 and 218 can communicate RF signals in accordance with specific communication standards, such as the Institute of Electrical and Electronics Engineers (IEEE) standards including IEEE 802.11(a), 802.11(b), 802.11(g), 802.11(h) and/or 802.11(n) standards and/or proposed specifications for wireless local area networks, although the scope of the invention is not limited in this respect as they can also be suitable to transmit and/or receive communications in accordance with other techniques and standards. In some BWA network embodiments, wireless access points 104 and 206 and handheld wager gaming units 102 and 218 can communicate RF signals in accordance with the IEEE 802.16-2004 and the IEEE 802.16(e) standards for wireless metropolitan area networks (WMANs) including variations and evolutions thereof, although the scope of the invention is not limited in this respect as they can also be suitable to transmit and/or receive communications in accordance with other techniques and standards. For more information with respect to the IEEE 802.11 and IEEE 802.16 standards, please refer to "IEEE Standards for Information Technology—Telecommunications and Information Exchange between Systems"—Local Area Networks—Specific Requirements—Part 11 "Wireless LAN Medium Access Control (MAC) and Physical Layer (PHY), ISO/IEC 8802-11: 1999", and Metropolitan Area Networks—Specific Requirements—Part 16: "Air Interface for Fixed Broadband Wireless Access Systems," May 2005 and related amendments/versions.

In some embodiments, wireless access points 104 and 206 and handheld wager gaming units 102 and 218 can include one or more antennas (not shown). These antennas can comprise directional or omnidirectional antennas, including, for example, dipole antennas, monopole antennas, patch antennas, loop antennas, microstrip antennas or other types of antennas suitable for transmission of the RF signals. In some multiple-input, multiple-output (MIMO) embodiments, two or more antennas can be used. In some embodiments, instead of two or more antennas, a single antenna with multiple apertures can be used. In these multiple aperture embodiments, each aperture can be considered a separate antenna. In some multi-antenna embodiments, each antenna can be effectively separated to take advantage of spatial diversity and the different channel characteristics that can result between each of the antennas and another wireless communication device. In some multi-antenna embodiments, the antennas of a device can be separated by up to 1/10 of a wavelength or more, although the scope of the invention is not limited in this respect.

In some embodiments, handoffs between different wireless access points 104 and one of handheld wager gaming units 102 and 218 can be performed based on a signal-to-noise ratio (SNR), a signal-to-noise and interference ratio (SNIR), a bit-error rate (BER), or an energy per received bit, although the scope of the invention is not limited in this respect.

In some embodiments, wireless access points 104 and 206 and handheld wager gaming units 102 and 218 can communicate in accordance with standards such as the Pan-European mobile system standard referred to as the Global System for Mobile Communications (GSM). In some embodiments, wireless access points 104 and 206 and handheld wager gaming units 102 and 218 can also communicate in accordance with packet radio services such as the General Packet Radio Service (GPRS) packet data communication service. In some embodiments, wireless access points 104 and 206 and handheld wager gaming units 102 and 218 can communicate in accordance with the Universal Mobile Telephone System (UMTS) for the next generation of GSM, which can, for example, implement communication techniques in accordance with 2.5G and third generation (3G) wireless standards (See 3GPP Technical Specification, Version 3.2.0, March 2000). In some of these embodiments, wireless access points 104 and 206 and handheld wager gaming units 102 and 218 can provide packet data services (PDS) utilizing packet data protocols (PDP). In other embodiments, wireless access points 104 and 206 and handheld wager gaming units 102 and 218 can communicate in accordance with other standards or other air-interfaces including interfaces compatible with the enhanced data for GSM evolution (EDGE) standards (see 3GPP Technical Specification, Version 3.2.0, March 2000), although the scope of the invention is not limited in this respect.

In other embodiments, wireless access points 104 and 206 and handheld wager gaming units 102 and 218 can communicate in accordance with a short-range wireless standard, such as the Bluetooth™ short-range digital communication protocol. Bluetooth™ wireless technology is a de facto standard, as well as a specification for small-form factor, low-cost, short-range radio links between mobile PCs, mobile phones and other portable devices. (Bluetooth is a trademark owned by Bluetooth SIG, Inc.) In other embodiments, wireless access points 104 and 206 and handheld wager gaming units 102 and 218 can communicate in accordance with an ultra-wideband (UWB) communication technique where a carrier frequency is not used. In other embodiments, wireless access points 104 and 206 and handheld wager gaming units 102 and 218 can communicate in accordance with an analog communication technique. In other embodiments, wireless access points 104 and 206 and handheld wager gaming units 102 and 218 can communicate in accordance with an optical communication technique, such as the Infrared Data Association (IrDA) standard. In some embodiments, wireless access points 104 and 206 and handheld wager gaming units 102 and 218 can communicate in accordance with the Home-RF standard which can be in accordance with a Home-RF Working Group (HRFWG) standard, although the scope of the invention is not limited in this respect.

Example Handheld Wager Gaming Unit Architecture

Figure 3:
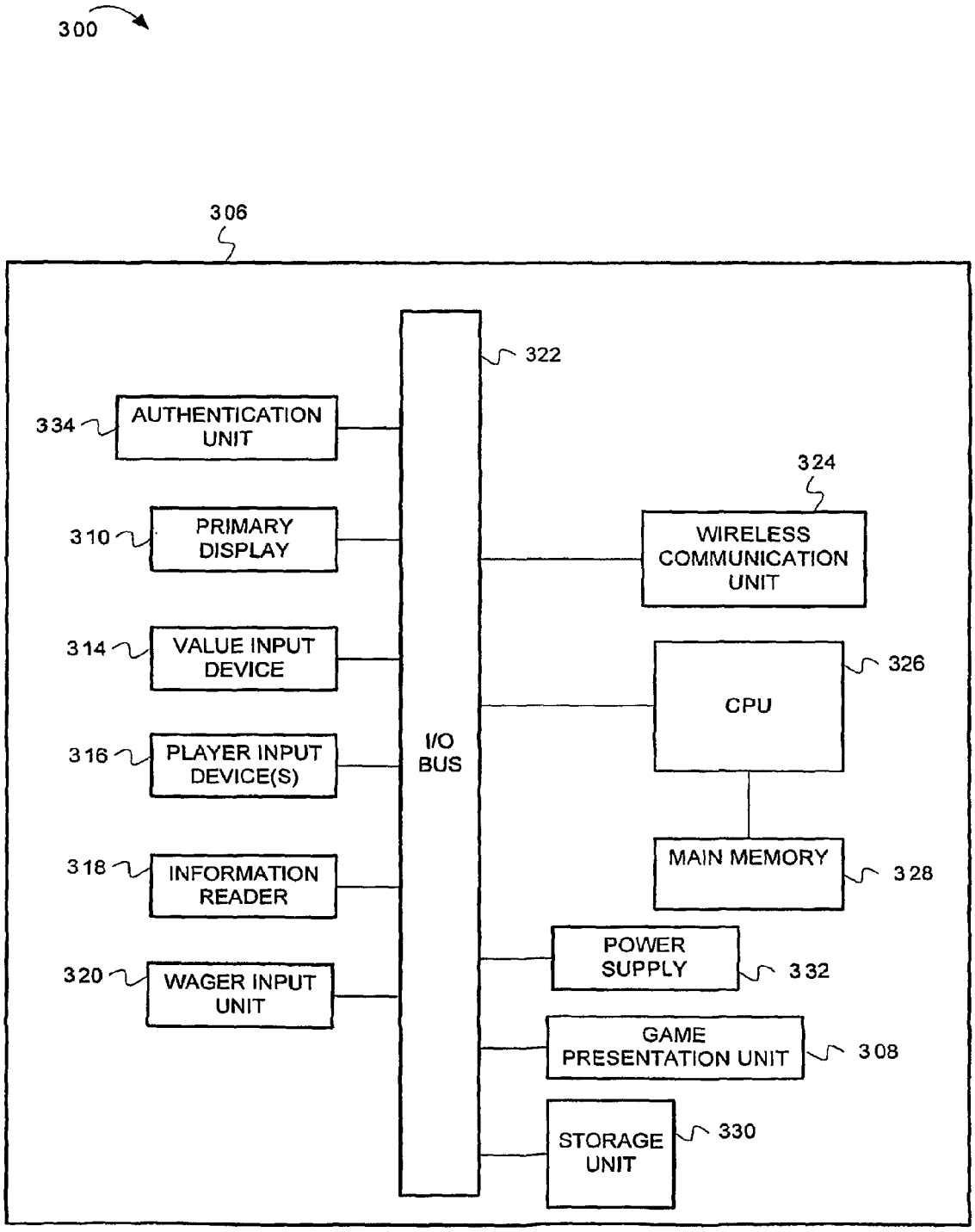
FIG. 3 is a block diagram illustrating an example handheld wager gaming unit architecture, according to example embodiments of the invention.

FIG. 3 is a block diagram illustrating an example handheld wager gaming unit architecture, according to example embodiments of the invention. As shown in FIG. 3, the handheld wager gaming unit 306 includes a central processing unit (CPU) 326 connected to main memory 328. The CPU 326 is also connected to an input/output (I/O) bus 322, which is connected to a power supply 332. The I/O bus 322 facilitates communication between and distributes power to the wager gaming machine's components. In one embodiment, the power supply 332 includes a rechargeable battery, such as a nickel cadmium battery.

The I/O bus 322 is connected to a game presentation unit 308 that can receive data indicating wagers and present wagering games, such as video poker, video black jack, video slots, video lottery, etc. The I/O bus 322 is also connected to a wireless communication unit 324, which includes logic for communicating to wireless access points and/or other external systems. The wireless communication unit 324 can work in concert with an authentication unit 334, which includes logic for authenticating user and network credentials. Additionally, the I/O bus 322 is connected to a primary display 310, value input device 314, player input device(s) 316, information reader 318, wager input unit 320, and storage unit 330.

In one embodiment, the handheld wager gaming unit 306 can include additional peripheral devices and/or more than one of each component shown in FIG. 3. For example, in one embodiment, the handheld wager gaming unit 306 can include multiple wireless communication units 324 and multiple CPUs 326. In one embodiment, any of the components can be combined or divided. Additionally, in one embodiment, the components of the wager gaming unit 306 can be interconnected according to any suitable interconnection architecture (e.g., bus architecture, directly connected, hypercube, etc.).

In one embodiment, any of the components of the handheld wager gaming unit 306 (e.g., the game presentation unit 308) can include hardware, firmware, and/or software for performing the operations described herein. In one embodiment, any of the handheld wager gaming unit's components (e.g., the game presentation unit 308) can be embodied as instructions stored on a machine-readable medium, where the instructions are executable on the CPU 326. Machine-readable media can include any mechanism that provides (i.e., stores and/or transmits) information in a form readable by a machine (e.g., a handheld wager gaming unit, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

While FIG. 3 describes an example handheld wager gaming unit architecture, this discussion continues with an example embodiment of a handheld wager gaming unit.

Example Handheld Wager Gaming Unit

Figure 4A:
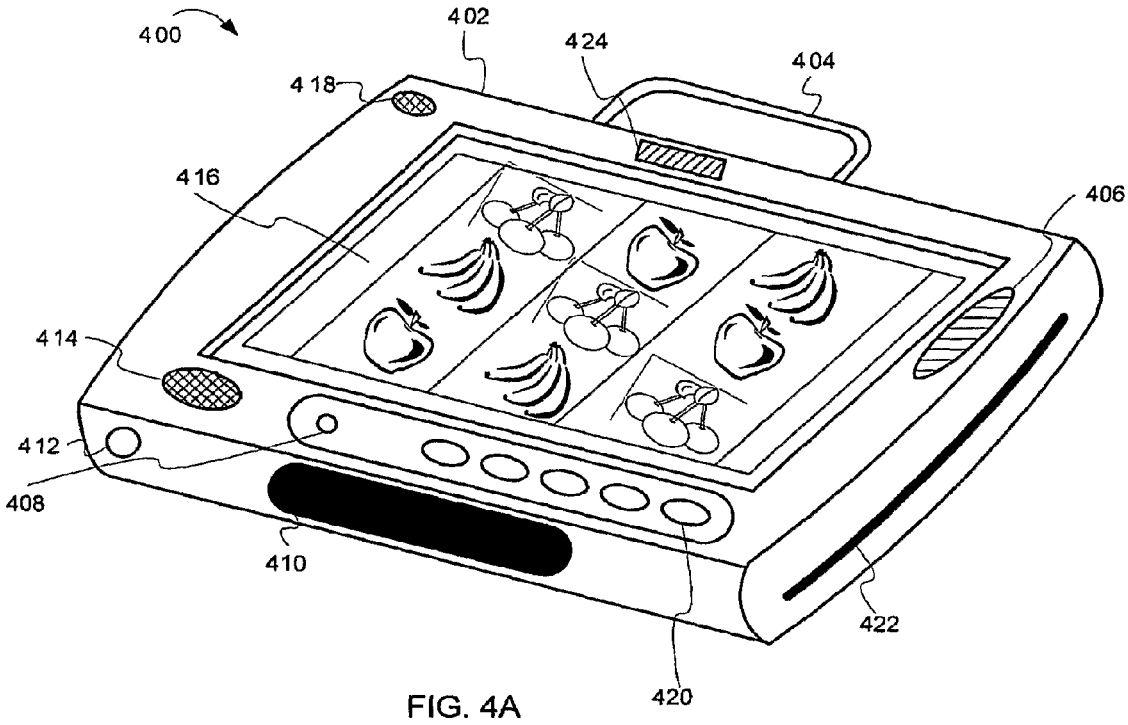
FIG. 4A is a top-side view of a handheld wager gaming unit, according to example embodiments of the invention.

FIG. 4A is a top-side view of a handheld wager gaming unit, according to example embodiments of the invention. As shown in FIG. 4A, the handheld wager gaming unit 400 includes a housing 402 for containing internal hardware and/or software such as that described above vis-à-vis FIG. 3. In one embodiment, the housing has a form factor similar to a tablet PC, while other embodiments have different form factors. For example, the handheld wager gaming unit 400 can exhibit smaller form factors, similar to those associated with personal digital assistants. In one embodiment, a handle 404 is attached to the housing 402. Additionally, the housing can store a foldout stand 410, which can hold the handheld wager gaming unit 400 upright or semi-upright on a table or other flat surface.

The handheld wager gaming unit 400 includes several input/output devices. In particular, the handheld wager gaming unit 400 includes buttons 420, audio jack 408, speaker 414, display 416, biometric device 406, wireless transmission devices 412 and 424, microphone 418, and card reader 422. Additionally, the handheld wager gaming unit can include tilt, orientation, ambient light, or other environmental sensors.

In one embodiment, the handheld wager gaming unit 400 uses the biometric device 406 for authenticating players, whereas it uses the display 416 and speakers 414 for presenting wagering game results and other information (e.g., credits, progressive jackpots, etc.). The handheld wager gaming unit 400 can also present audio through the audio jack 408 or through a wireless link such as Bluetooth.

In one embodiment, the wireless communication unit 412 can include infrared wireless communications technology for receiving wagering game content while docked in a wager gaming station 216. The wireless communication unit 424 can include an 802.11G transceiver for connecting to and exchanging information with wireless access points 206. The wireless communication unit 424 can include a Bluetooth transceiver for exchanging information with other Bluetooth enabled devices.

Figure 4B:
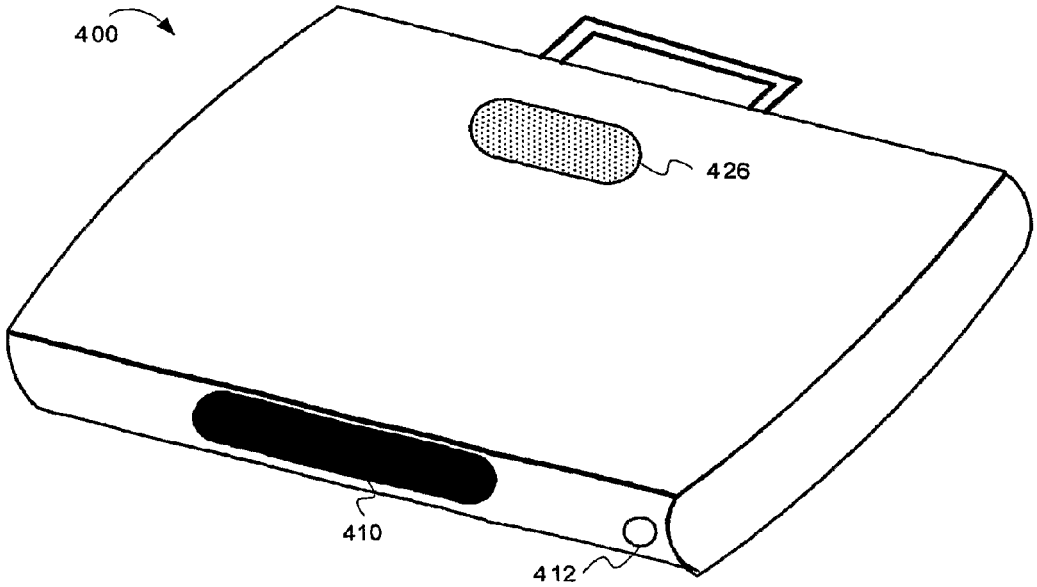
FIG. 4B is a bottom-side view of a handheld wager gaming unit, according to example embodiments of the invention.

FIG. 4B is a bottom-side view of a handheld wager gaming unit, according to example embodiments of the invention. As shown in FIG. 4B, the handheld wager gaming unit 400 includes a docking port 426. In one embodiment, the docking port 426 can include surface-contact charging pads or other facilities for recharging the handheld wager gaming unit's battery (not shown). The docking port 426 can also include a network interface (e.g., Ethernet interface) through which a wager gaming station 216 can communicate with and test the handheld wager gaming unit 400.

In one embodiment, the handheld wager gaming unit 400 is constructed from damage resistant materials, such as polymer plastics. Portions of the handheld wager gaming unit 400 can be constructed from non-porous plastics which exhibit antimicrobial qualities. Also, the unit 400 can be liquid resistant for easy cleaning and sanitization.

While this section has described components of a wager gaming network, the next section describes operations performed by the wager gaming network components.

Example Operations

This section describes operations performed by embodiments of the invention. In the discussion below, the flow diagrams will be described with reference to the block diagrams presented above. In certain embodiments, the operations are performed by instructions residing on machine-readable media (e.g., software), while in other embodiments, the operations are performed by hardware and/or other logic (e.g., digital logic). In some embodiments the operations are performed in series, while in other embodiments, the operations can be performed in parallel.

Figure 5:
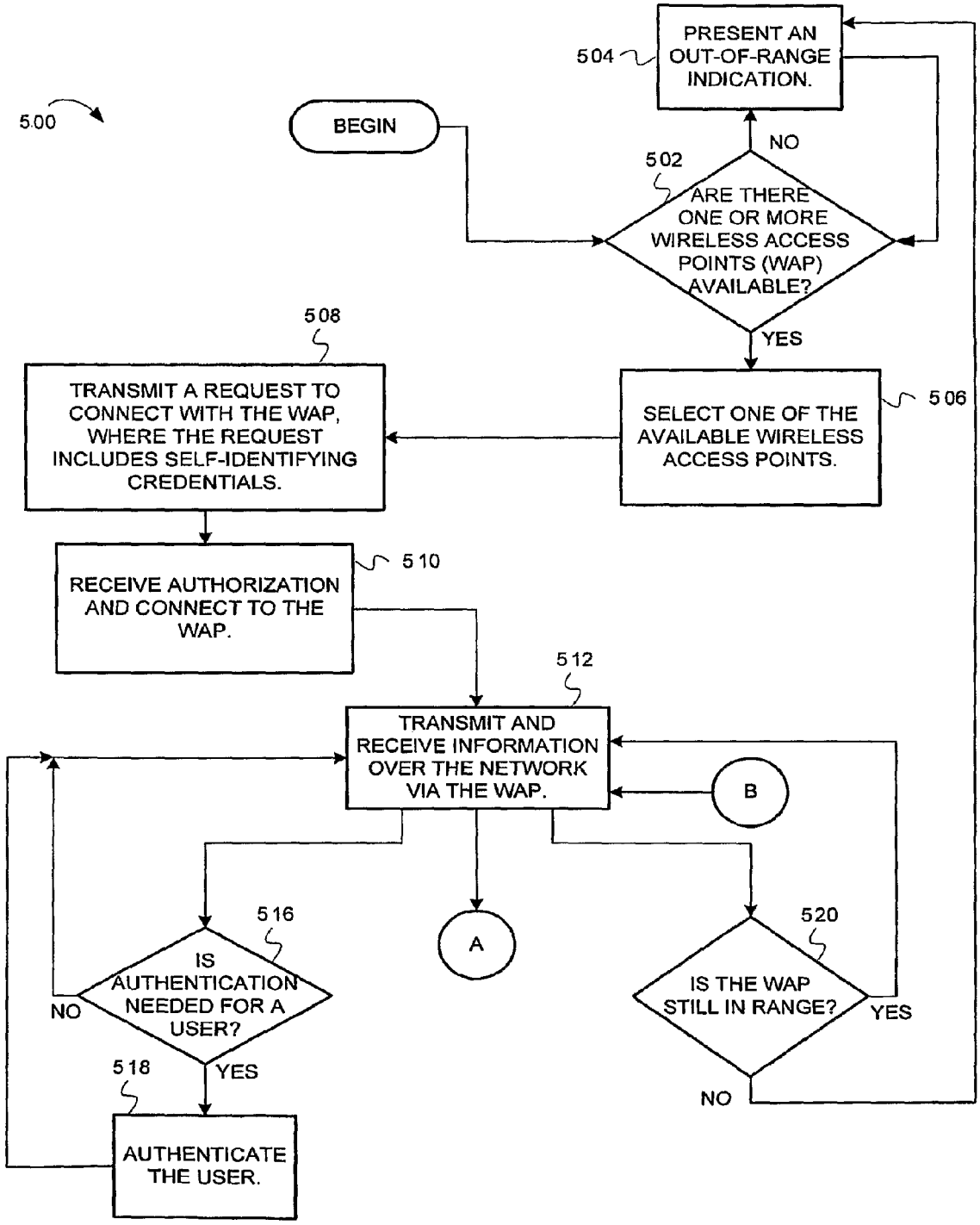
FIG. 5 is a flow diagram illustrating operations performed by a handheld wager gaming device, according to example embodiments of the invention.
Figure 6:
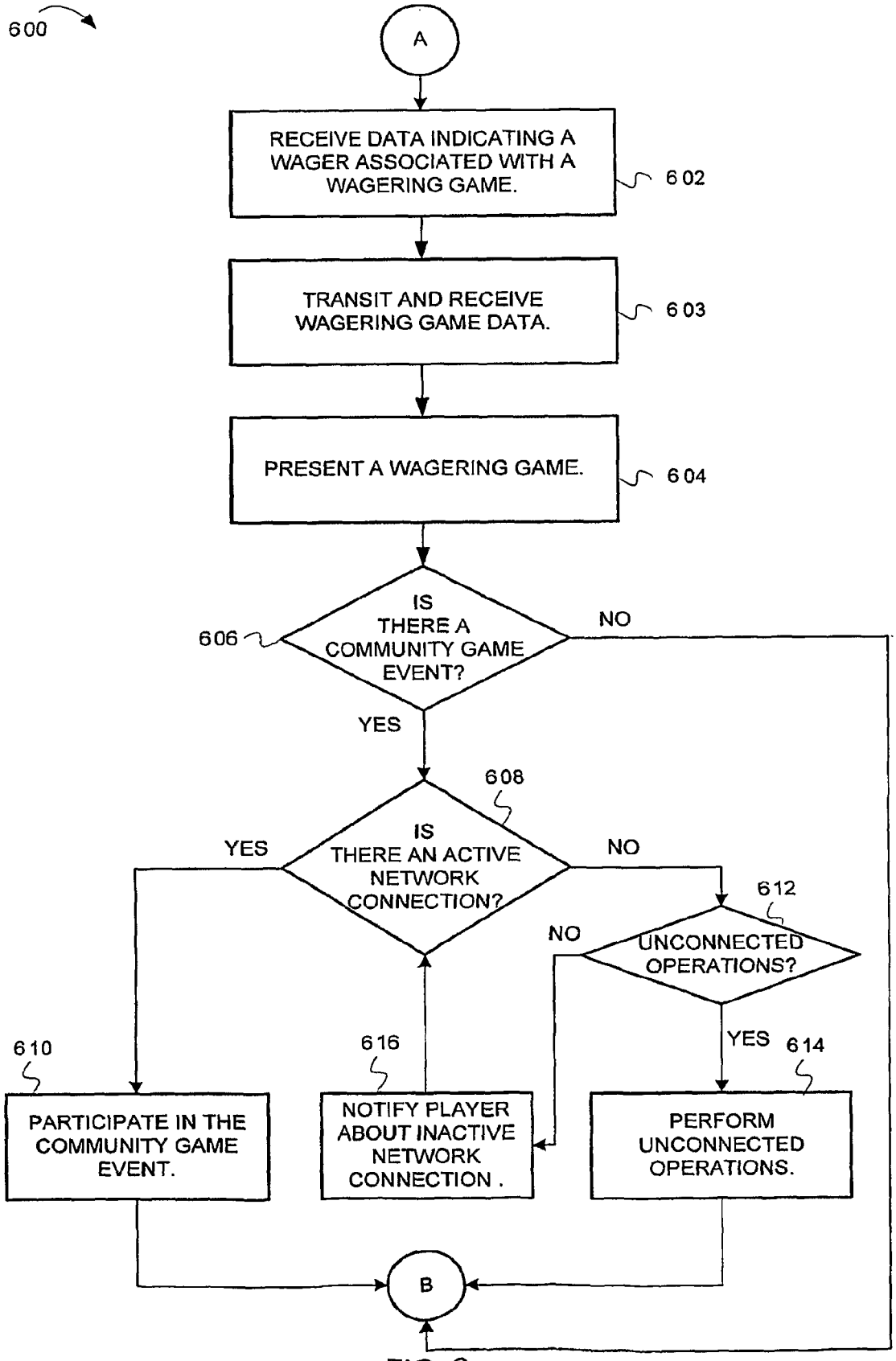
FIG. 6 is a flow diagram illustrating operations for conducting wagering games and participating in network-based community games using a handheld wager gaming unit, according to example embodiments of the invention.

This section begins with a discussion of FIGS. 5 and 6, which describe operations performed by embodiments of a handheld wager gaming device. In particular, FIG. 5 describes operations for connecting to wireless access points and authenticating wagering game players. FIG. 6 describes operations for conducting wagering games and participating in community games.

FIG. 5 is a flow diagram illustrating connection and authentication operations of a handheld wager gaming unit, according to example embodiments of the invention. The flow 500 commences at block 502.

At block 502, a handheld wager gaming unit's wireless communication unit 324 determines whether there are one or more wireless networks access points 206 available. In one embodiment, the wireless communication unit 324 passively scans the air for Wi-Fi beacons broadcast by each wireless access point 206. Other embodiments use other suitable methods for detecting wireless connectivity. If no wireless access points are available, the flow continues at block 504. Otherwise, the flow continues at block 506.

At block 504, the wireless communication unit 324 presents an indication, on its primary display 310, that no wireless access points 206 are available. The flow continues at block 502.

At block 506, the wireless communication unit 324 determines that it will connect to a wireless access point 206. In one embodiment, if more than one wireless access point 206 is available, the wireless communication unit 324 will choose the wireless access point 206 associated with the strongest signal. The flow continues at block 508.

At block 508, the wireless communication unit 324 transmits a request to connect to the wireless access point 206. In one embodiment, the request includes credentials identifying the handheld wager gaming unit 306. In one embodiment, the authentication unit 334 provides the credentials to the wireless communication unit 324. The flow continues at block 510.

At block 510, the wireless communication unit 324 receives authorization to connect to the wireless access point 206. The flow continues at block 512.

At block 512, the wireless communication unit 324 exchanges information with devices on the wager gaming network 200. For example, the wireless communication unit 324 can receive from the community game controller 208 information about community games. From block 512, the flow can continue in parallel at block 516, block 520, and block 602 of FIG. 6.

At block 516, the authentication unit 334 determines whether it needs to authenticate a player. In one embodiment, the authentication unit 334 can periodically authenticate players in between wagering games. In one embodiment, the authentication unit 334 authenticates players in response to signals received through the wireless communication unit 324. If authentication is needed, the flow continues at block 518.

At block 518, the authentication unit 334 authenticates the user. In one embodiment, the authentication unit 334 can collect a player's biometric information, (e.g., fingerprint) and compare it to trusted biometric information. In an alternate embodiment, the authentication unit 334 can collect a player's biometric information and forward this information to a central server or other device for authentication. In one embodiment, the authentication process includes verifying a player's age and identity. If the authentication is successful, the flow continues at block 512. Otherwise, the flow ends.

At block 520, the wireless communication unit 324 determines whether the wireless access point 206 is still within range. If the wireless access point 206 is not within range, the flow continues at block 504. Otherwise, the flow continues at block 512.

FIG. 6 is a flow diagram illustrating operations for conducting wagering games and participating in network-based community games using a handheld wager gaming unit, according to example embodiments of the invention. The flow 600 begins at block 602.

At block 602, a handheld wager gaming unit's value input device 314 receives data indicating a wager associated with a wagering game. In one embodiment, the value input device 314 notifies the game presentation unit 308 of the wagering game data. The flow continues at block 603.

At block 603, the handheld wager gaming unit's wireless communication unit 324 exchanges wagering game data with the wagering game controller 202. In one embodiment, the handheld wager gaming unit transmits the data collected at block 602, while receiving data indicating intermediate and/or final results of the wagering game. The flow continues at block 604.

At block 604, the game presentation unit 308 presents the wagering game. For example, the game presentation unit 308 uses the wagering game data (e.g., intermediate and/or final game results) received at block 603 in presenting a slots game. Based on the wagering game data, the game presentation unit 308 presents the wagering game on the primary display 310 and displays winning credits on the credit meter.

Although blocks 602, 603, and 604 describe embodiments in which the handheld wager gaming device presents wagering games based on results determined at the wager gaming controller 202, other embodiments of the handheld wager gaming unit 306 themselves determine the wagering game results.

The flow continues at block 606.

At block 606, the game presentation unit 308 determines whether it can participate in a community game event. In one embodiment, if a wagering game results in a particular outcome, the game presentation unit 308 can participate in a community game. If there is a community game event, the flow continues at block 608. Otherwise, the flow continues at "B", which passes into flow 500's block 512 (see FIG. 5).

At block 608, the wireless communication unit 324 determines whether there is an active network connection. In one embodiment, there is an active network connection if the wireless communication unit 324 has already connected to a wireless access point 206 (see block 510 of FIG. 5) and is within transmission range. If there is an active network connection, the flow continues at block 610. Otherwise, the flow continues at block 612.

At block 610, the game presentation unit 308 participates in the community game event. In one embodiment, the game presentation unit 308 uses the wireless communication unit 324 to exchange community game information with a community game controller 208. In one embodiment, the handheld wager gaming unit 306 transmits player selections to the community game controller 208, while receiving and presenting community game results. In another embodiment, community game results are presented on the community game controller's overhead display 210. The flow continues at "B", which passes into flow 500's block 512 (see FIG. 5).

At block 612, because there is not an active network connection, the game presentation unit 308 determines whether it can perform unconnected community game operations. If the game presentation unit 308 can perform unconnected community game operations the flow continues at block 614. Otherwise the flow continues at block 616.

At block 614, the game presentation unit 308 performs unconnected community game operations. In one embodiment, the game presentation unit 308 simulates a community game. In another embodiment, the game presentation unit 308 conducts a non-community bonus event. The flow continues at "B", which passes into flow 500's block 512 (see FIG. 5).

At block 616, the wireless communication unit 324 notifies the player about an inactive network connection. The flow continues at block 608.

While FIGS. 5 and 6 describe operations performed by embodiments of a handheld wager gaming unit, this description continues with a discussion about operations for conducting a community game.

Figure 7:
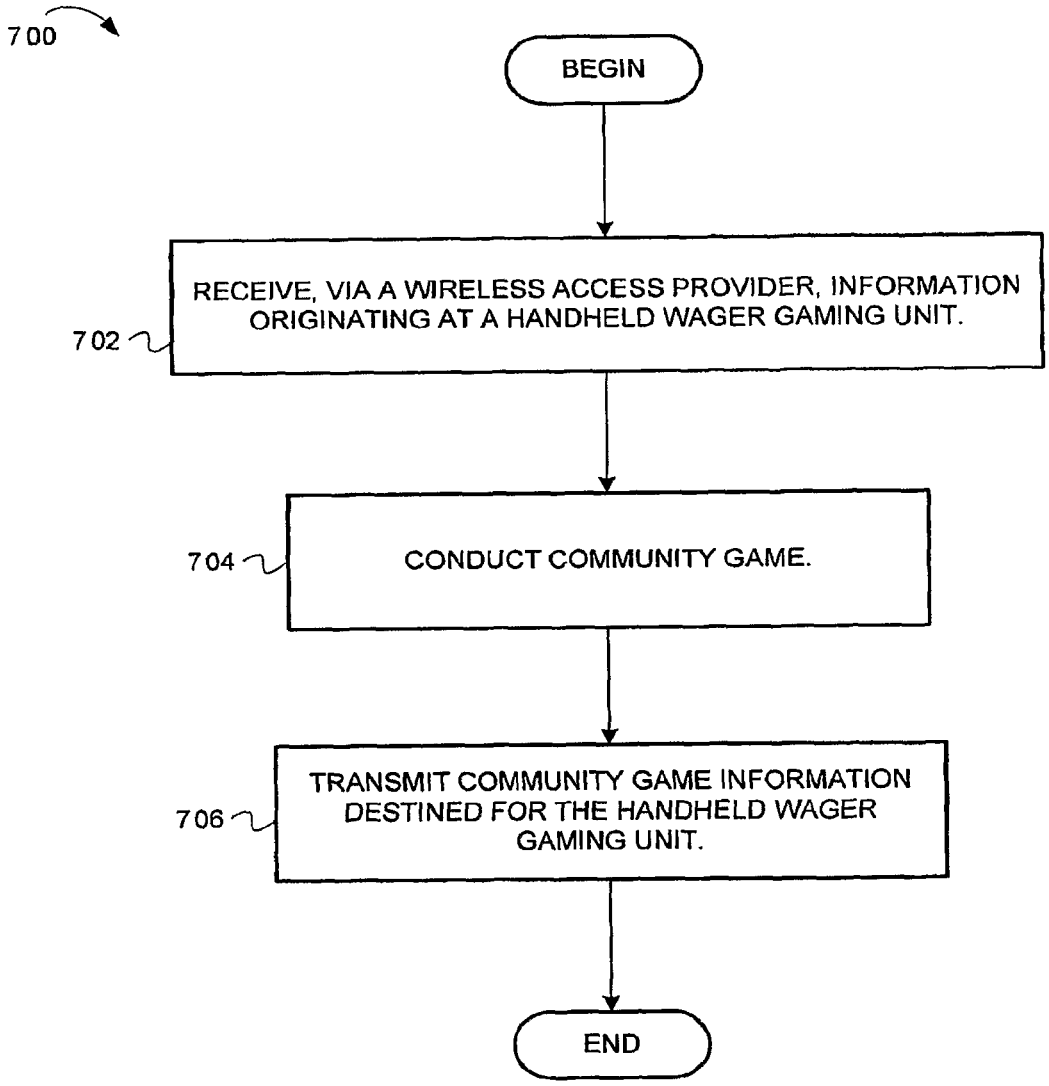
FIG. 7 is a flow diagram illustrating operations for conducting community games, according to example embodiments of the invention.

FIG. 7 is a flow diagram illustrating operations for conducting community games, according to example embodiments of the invention. The flow 700 begins at block 702.

At block 702, the community game controller 208 receives community gaming information originating from a handheld wager gaming unit 218. The community game controller 208 receives the community gaming information through a wireless access point 206. In one embodiment, the community gaming information can include a request to participate in a community game, player selections associated with a community game, etc. The flow continues at block 704.

At block 704, the community game controller 208 conducts a community game. The flow continues at block 706.

At block 706, the community game controller 208 transmits community game information destined for the handheld wager gaming unit 218. In one embodiment, the community game information travels over the wager gaming network through the wireless access point 206 to the handheld wager gaming unit 218. In one embodiment, the wager gaming information can include final or intermediate community game results, requests for player input, etc. From block 706, the flow ends.

Figure 8:
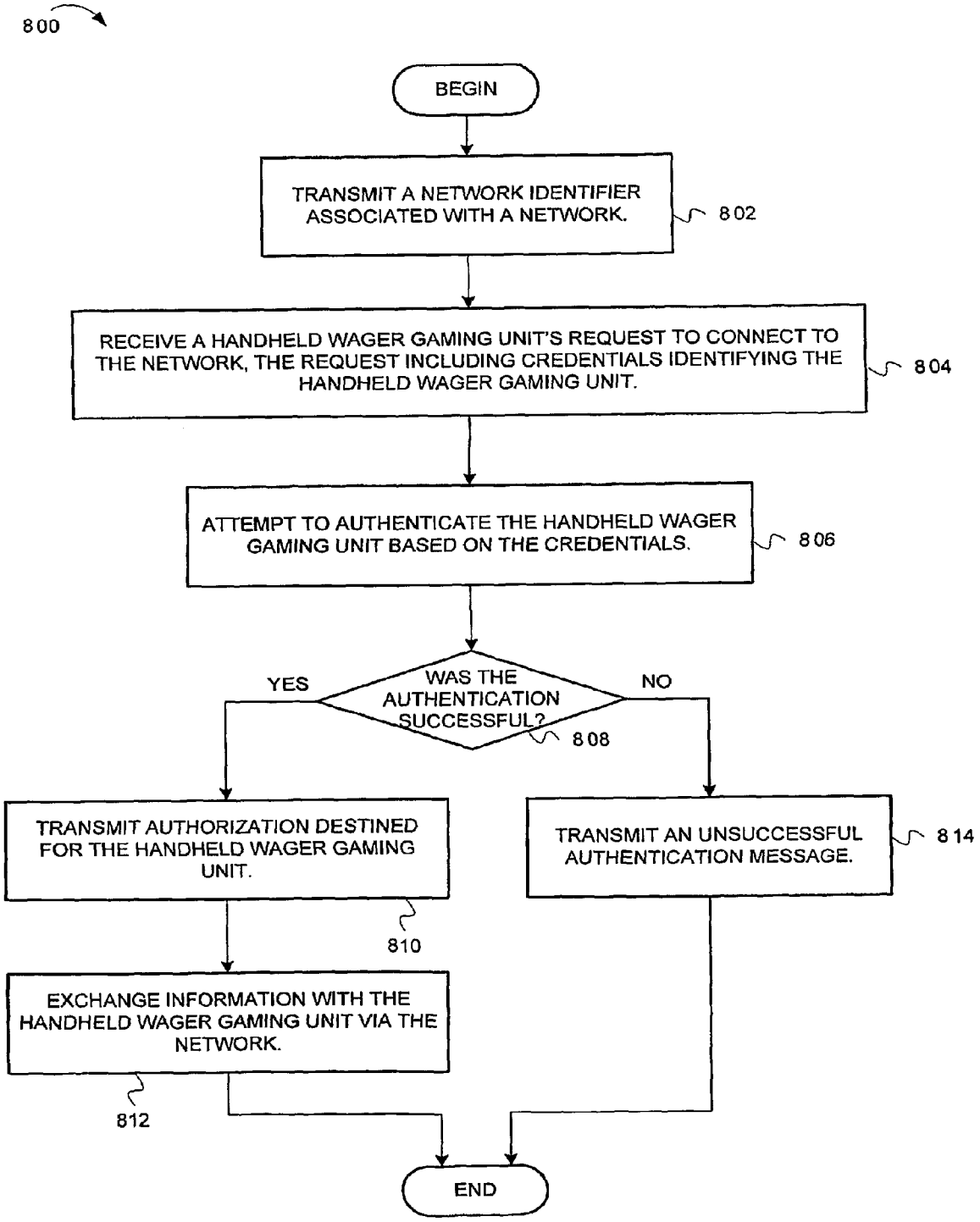
FIG. 8 is a flow diagram illustrating operations for providing wireless access for handheld wager gaming units, according to example embodiments of the invention.

FIG. 8 is a flow diagram illustrating operations for providing wireless access for handheld wager gaming units, according to example embodiments of the invention. The flow 800 begins at block 802.

At block 802, a wireless access point 206 transmits a network identifier associated with the wager gaming network 200. The flow continues at block 804.

At block 804, the wireless access point 206 receives from a handheld wager gaming unit 218 a request to connect to the wager gaming network 200. In one embodiment, the request includes credentials for identifying the handheld wager gaming unit 218 (e.g., digital certificates or other suitable authentication information). The flow continues at block 806.

At block 806, the wireless access point 206 attempts to authenticate the handheld wager gaming unit 218. In one embodiment, the wireless access point 206 attempts to authenticate a digital certificate received at block 804. In one embodiment, the wireless access point 206 authenticates the handheld wager gaming unit 218 with assistance from other wager gaming network devices, such as the wager gaming controller 202. The flow continues at block 808.

At block 808, the wireless access point 206 determines whether authentication was successful. If the authentication was successful, the flow continues at block 810. Otherwise, the flow continues at block 814.

At block 810, the wireless access point 206 transmits authorization to the handheld wager gaming unit 218. The flow continues at block 812.

At block 812, the wireless access point 206 passes wager gaming information between the handheld wager gaming unit 218 and other wager gaming network devices. In one embodiment, the operations at blocks 802 through 810 are transparent to players. Thus, players can switch between wireless access points 206 without disturbing on-going community games. As a result, the wager gaming information exchanged at block 810 can be associated with community games already in progress. In another embodiment, the wager gaming information can relate to new community games or requests for information (e.g., show times, reservations, etc.). From block 812, the flow ends.

At block 814, because the authentication was unsuccessful, the wireless access point 206 transmits an unsuccessful authentication message. From block 814, the flow ends.

This description will continue with a discussion of operations for checking-in and checking-out handheld wager gaming units. In one embodiment, the handheld wager gaming units are tested, recharged, and sanitized between lending sessions. A discussion of FIG. 9 is next.

Figure 9:
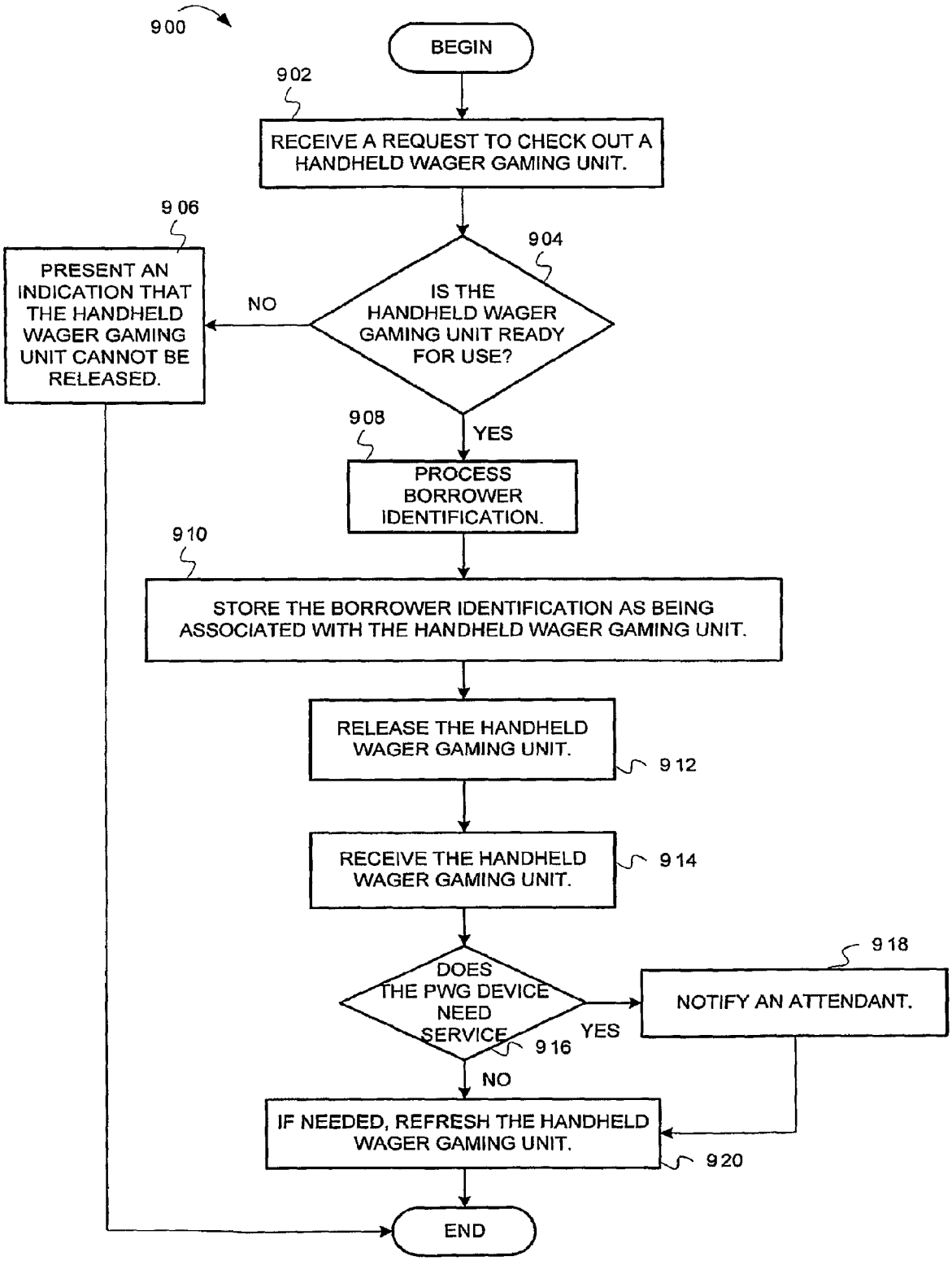
FIG. 9 is a flow diagram illustrating operations for issuing, receiving, and refreshing handheld wager gaming units, according to example embodiments of the invention.

FIG. 9 is a flow diagram illustrating operations for issuing, receiving, and refreshing handheld wager gaming units, according to example embodiments of the invention. The flow 900 begins at block 902.

At block 902, a wager gaming station 216 receives a request to check-out a handheld wager gaming unit 218. The wager gaming station 216 can select a particular handheld wager gaming unit 218 or it can allow the customer to select a unit 218. The flow continues at block 904.

At block 904, the wager gaming station 216 determines whether the handheld wager gaming unit is ready for use. In one embodiment, the wager gaming station 216 determines whether processes for sanitization, battery charging, and software updating have completed. If the handheld wager gaming unit is ready for use, the flow continues at block 908. Otherwise, the flow continues at block 906.

At block 906, the wager gaming station 216 presents an indication that the handheld wager gaming unit cannot be issued. In one embodiment, the wager gaming station 216 illuminates certain lights or presents a message on a video device. From block 906, the flow ends.

At block 908, the wager gaming station 216 collects the borrower's identification information. In one embodiment, the wager gaming station 216 receives and stores biometric information associated with a player who is checking out the handheld wager gaming unit 216. The flow continues at block 910.

At block 910, the wager gaming station 216 stores the borrower identification information. In one embodiment, the wager gaming station 216 creates an association between the barrower identification information and the handheld wager gaming unit 218. The flow continues at block 912.

At block 912, the wager gaming station 216 releases or delivers the handheld wager gaming unit to a player. In one embodiment, the wager gaming station 216 releases a security mechanism, allowing the player to remove the handheld wager gaming unit 218 from the wager gaming station 216. The flow continues at block 914.

At block 914, the wager gaming station 216 receives the handheld wager gaming unit. The wager gaming station 216 can receive the handheld wager gaming unit 218 after a player has finished a wager gaming session. The flow continues at block 916.

At block 916, the wager gaming station 216 determines whether the handheld wager gaming unit needs service. In one embodiment, the wager gaming station 216 runs a test suite to determine whether the handheld wager gaming unit's components (e.g., display, buttons, etc.) are functioning properly. If the handheld unit needs service, the flow continues at block 918. Otherwise, the flow continues at block 920.

At block 918, because the handheld wager gaming unit is not functioning properly, the wager gaming station 216 notifies an attendant. The flow continues at block 920.

At block 920, the wager gaming station 216 refreshes the handheld wager gaming unit 218. In one embodiment, the wager gaming station 216 recharges the handheld unit's batteries and updates its software. The wager gaming station can sanitize the handheld wager gaming unit 218. In one embodiment, the wager gaming station 216 submerses the handheld wager gaming unit 218 in an ozone bath. In an another embodiment, the wager gaming station 216 applies an antimicrobial cleaner to the handheld unit 218. From block 920, the flow ends.

In one embodiment, the request can come in the form of a player swiping a "check-out card" through a game station card reader (not shown). The request can also come in the form of a pass code entry or button actuation.

Example Wager Gaming Station Security Features

Figure 10:
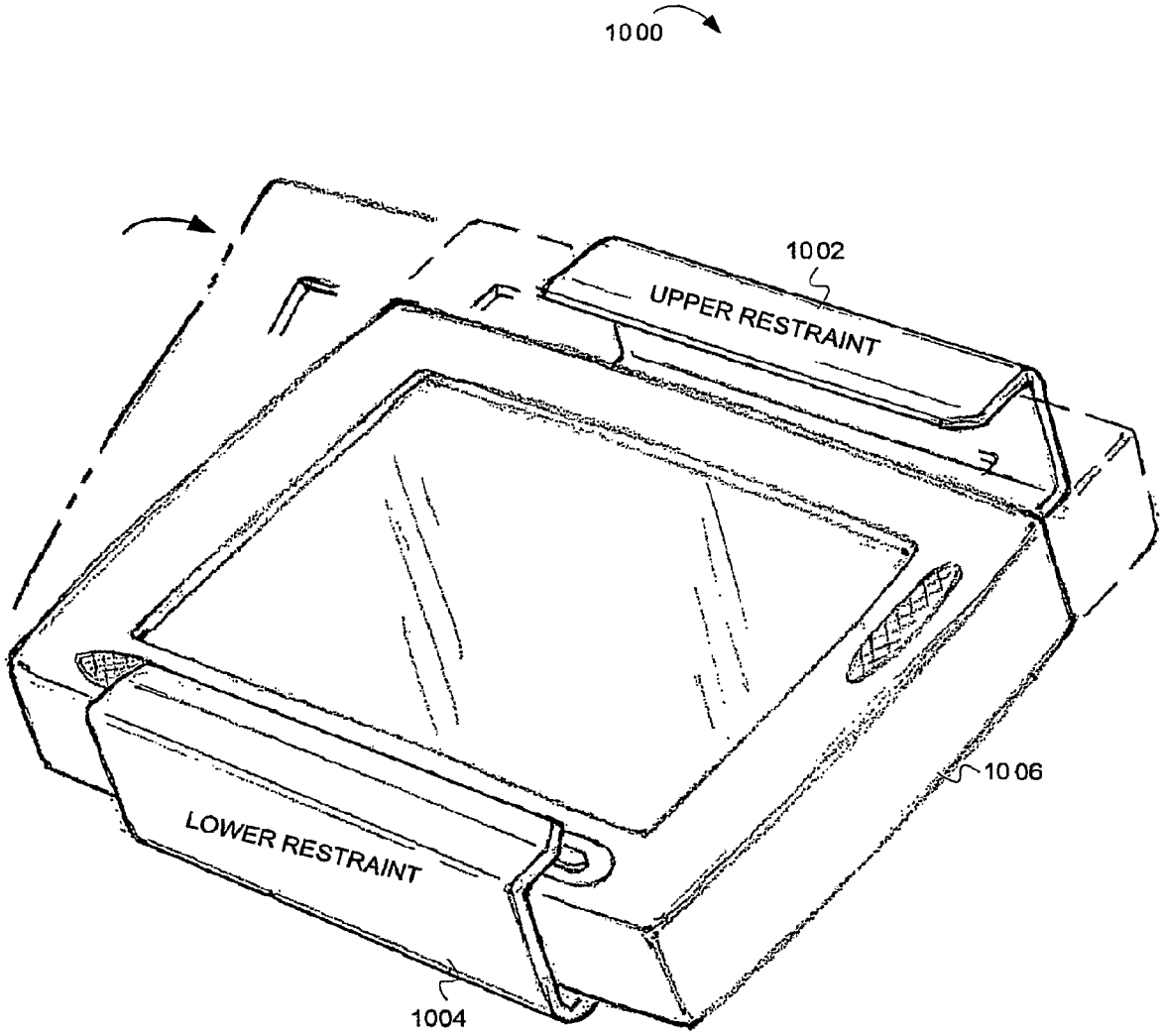
FIG. 10 is a perspective view of a locking device for securing handheld wager gaming units in a wager gaming station, according to example embodiments of the invention.
Figure 11:
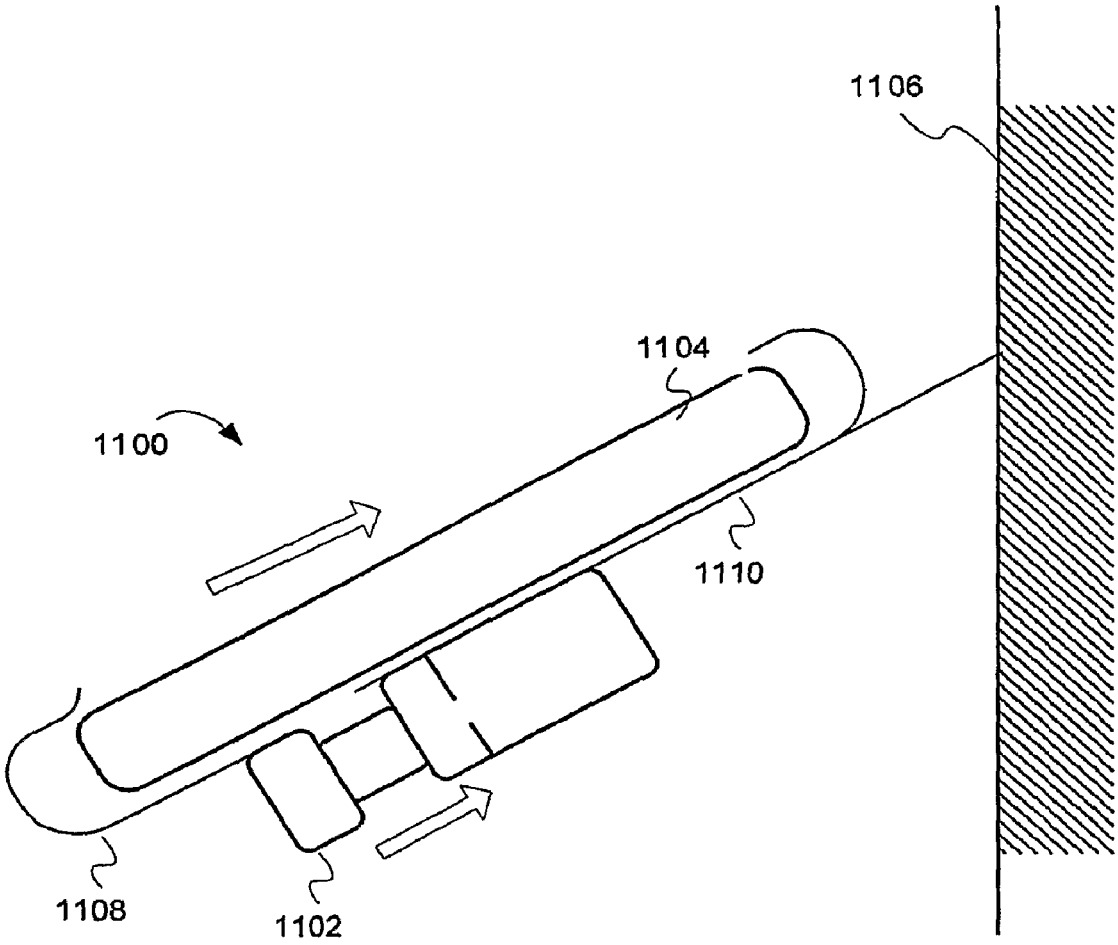
FIG. 11 is a side view of a locking device for securing handheld wager gaming units in a wager gaming station, according to example embodiments of the invention.
Figure 12:
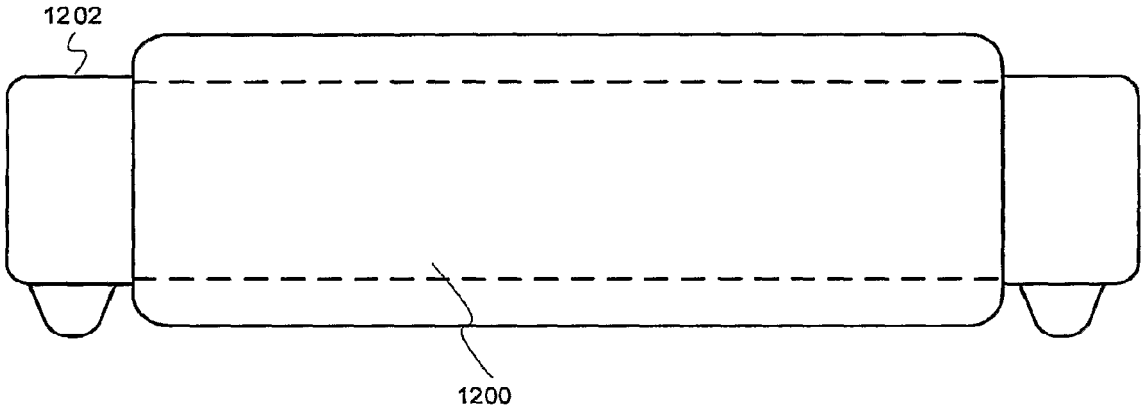
FIG. 12 is a bottom view of a locking device for securing handheld wager gaming units in a wager gaming station, according to example embodiments of the invention.
Figure 13:
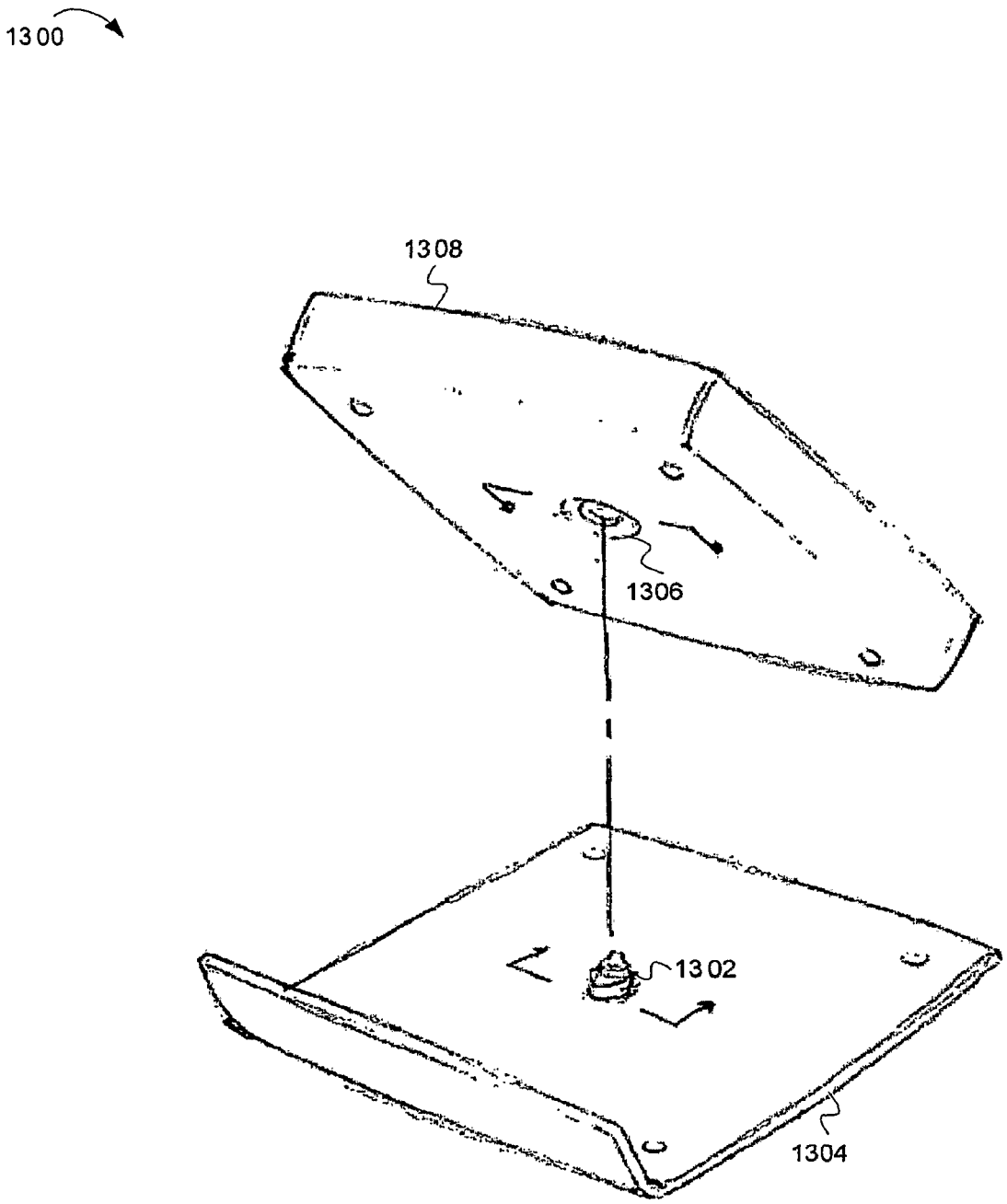
FIG. 13 is a perspective view of a mechanism for securing a handheld wager gaming units to a wager gaming station, according to example embodiments of the invention.
Figure 14:
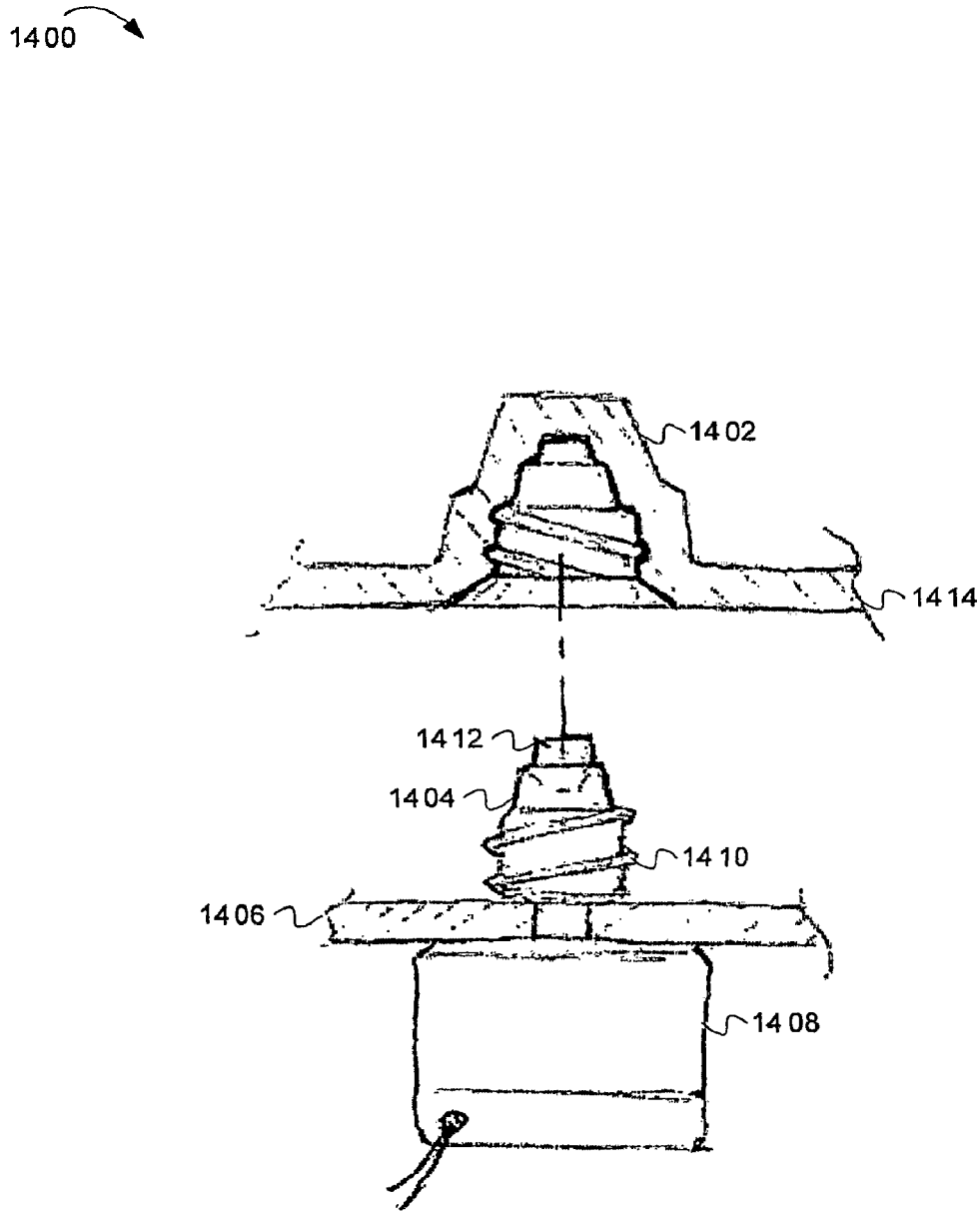
FIG. 14 is a side view of a locking mechanism and socket for securing a handheld wager gaming unit to a wager gaming station, according to example embodiments of the invention.
Figure 16:
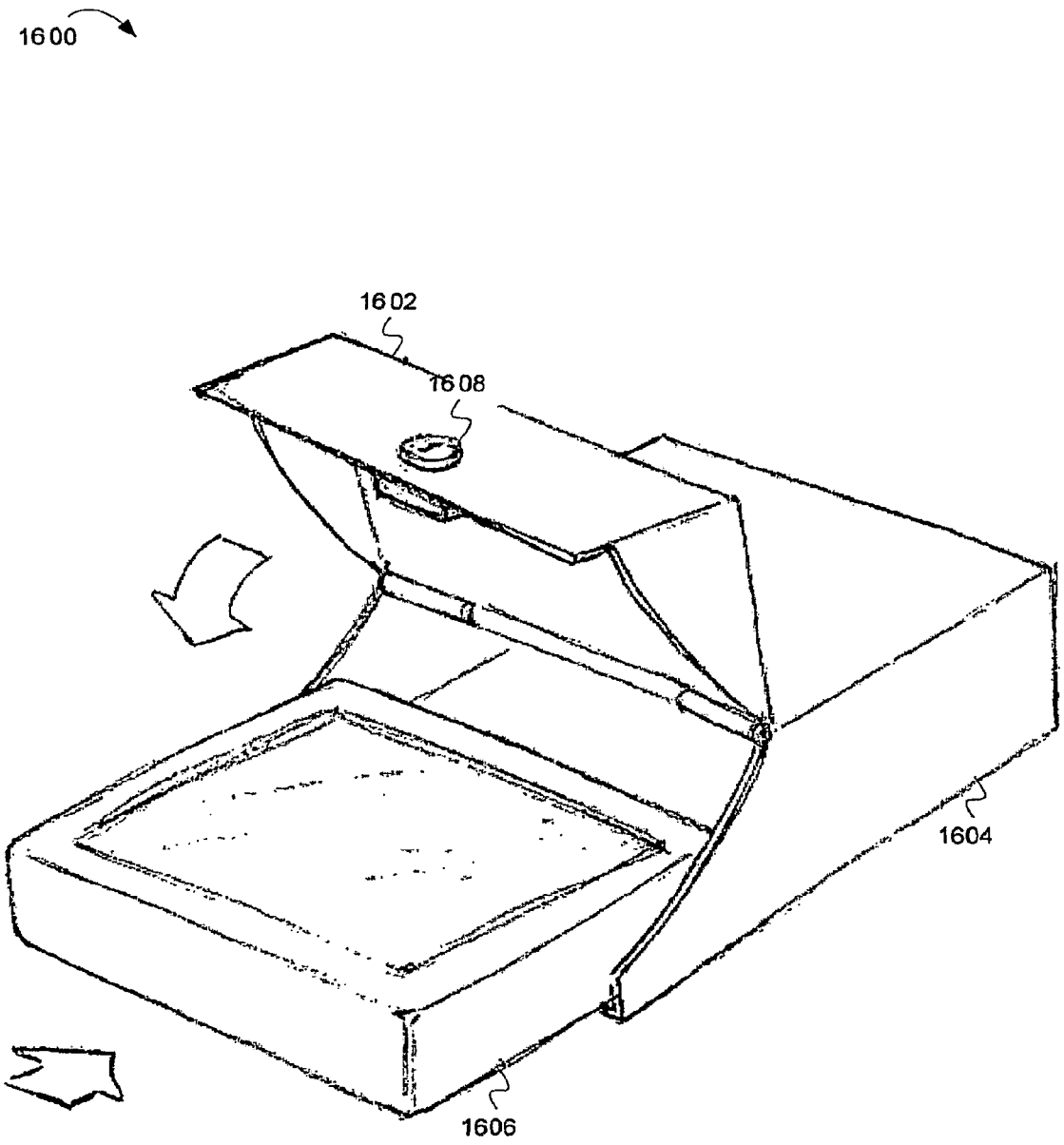
FIG. 16 is a perspective view of a handheld wager gaming unit lock box for securing a handheld wager gaming unit in a wager gaming station, according to example embodiments of the invention.

This section describes several devices for securing handheld wager gaming units in wager gaming stations. In particular, FIGS. 10-12 present a restraint-type security device, FIGS. 13 and 14 present a plug-and-socket-type security device, FIGS. 15A-C present a latching-type security device, and FIG. 16 presents a box-type security device. This description continues with a discussion of FIG. 10.

FIG. 10 is a perspective view of a locking device for securing handheld wager gaming units in a wager gaming station, according to example embodiments of the invention. As shown in FIG. 10, one embodiment of the locking device 1000 includes an upper restraint 1002 and lower restraint 1004 for receiving a handheld wager gaming unit 1006. In one embodiment, either or both of the restraints 1002 and 1004 are slide-mounted, enabling them to slide tightly around a handheld wager gaming unit 1006. After sliding around the handheld wager gaming unit 1006, the restraints 1002 and 1004 can lock into place, securing the handheld wager gaming unit 1006 from theft or unauthorized removal.

FIG. 11 is a side view of a locking device for securing handheld wager gaming units in a wager gaming station, according to example embodiments of the invention. As shown in FIG. 11, the locking device 1100 includes a sliding apparatus 1102, which enables a lower restraint 1108 to adjust to a size suitable for securing the handheld wager gaming unit 1104. In one embodiment, the sliding apparatus 1102 is connected to a support plate 1110, which is connected to a support member 106 of the wager gaming station. In one embodiment, the sliding apparatus includes electronic components (e.g., a motor) for adjusting the lower restraint 1108. The electronic components can be remotely activated by a computer or other electronic device.

FIG. 12 is a bottom view of a locking device for securing handheld wager gaming units in a wager gaming station, according to example embodiments of the invention. As shown in FIG. 12, the locking device 1200 can securely support and contain a handheld wager gaming unit 1202. In one embodiment, the handheld wager gaming unit 1202 includes a foot 1206, which prevents the handheld wager gaming unit 1202 from sliding out of the locking device 1200. In another embodiment, a locking device 1200 envelops the handheld wager gaming unit 1202 such that it cannot slide out from the locking device 1200.

This description will now discuss a plug-and-socket-type security device.

FIG. 13 is a perspective view of a mechanism for securing a handheld wager gaming units to a wager gaming station, according to example embodiments of the invention. As shown in FIG. 13, a locking mechanism 1302 is mounted on a plate 1304, which can receive and support a handheld wager gaming unit 1308. The handheld wager gaming unit 1308 includes a socket 1306 for mating to the locking mechanism 1302. The locking mechanism 1302 can include threads that intertwine with threads in the socket 1306. Additionally, the locking mechanism 1302 can include a motor to tighten the threads, as the locking mechanism 1302 mates with the socket 1306. In one embodiment, the locking mechanism 1302 includes a latch or other device for coupling it to the handheld wager gaming unit's socket 1306. Embodiments of the socket and locking mechanism are described in more detail in FIG. 14.

FIG. 14 is a side view of a locking mechanism and socket for securing a handheld wager gaming unit to a wager gaming station, according to example embodiments of the invention. As shown in FIG. 14, the locking mechanism 1404 includes threads 1410, contact switch 1412 and motor 1408. The locking mechanism 1404 and motor 1408 can be mounted on a plate 1406, which is connected to a wager gaming station (not shown).

In FIG. 14, a handheld wager gaming unit 1414 includes a socket 1402, which can receive the locking mechanism 1404. In one embodiment, the socket 1402 includes threads which can mate with the locking mechanism's threads 1410. The contact switch 1412 and motor 1408 can be used for turning the locking mechanism's threads 1410 in order to securely couple the locking mechanism 1404 with the socket 1402. In one embodiment, the motor 1408 can be activated to release a handheld wager gaming unit 1414 as a result of computerized operations, such as electronically authenticating a prospective user of the handheld wager gaming unit 1412.

This description continues with another mechanism for securing a handheld wager gaming unit to a wager gaming station. FIG. 15A is next.

FIG. 15A is a side view of a latching mechanism for securing a handheld wager gaming unit to a wager gaming station, according to example embodiments of the invention. As shown in FIG. 15A, a wager gaming station (not shown) can include a plate 1508 and latches 1504 for supporting and securing a handheld wager gaming unit 1502 to the wager gaming station. Each latch 1504 can be connected to a spring 1506, which enables the latch 1504 mate to a ridge 1510 of the handheld wager gaming device 1502. FIGS. 15B and 15C describe the mating in more detail.

FIG. 15B is a side view of a handheld wager gaming unit mating with a wager gaming station's latches, according to example embodiments of the invention. When the handheld wager gaming unit 1502 is pressed onto the plate 1508 the latches 1504 adjust outward to mate with the handheld wager gaming unit's ridges 1510.

FIG. 15C is side view of a handheld wager gaming unit mated to a wager gaming station's latches, according to example embodiments of the invention. As shown, after pressing the handheld wager gaming unit 1502 onto the plate 1508, the latches 1504 can lock into position, securing the handheld wager gaming unit 1502 to the wager gaming station's plate 1508.

This description continues with yet another means by which a wager gaming station can secure a handheld wager gaming unit. A discussion of FIG. 16 is next.

FIG. 16 is a perspective view of a handheld wager gaming unit lock box for securing a handheld wager gaming unit in a wager gaming station, according to example embodiments of the invention. As shown in FIG. 16, a handheld wager gaming unit lock box 1600 includes a door 1602 connected to a body 1604. The door 1602 includes a key lock 1608. The handheld wager gaming unit lock box 1600 is sized to fully enclose the handheld wager gaming unit 1606. After the handheld wager gaming unit 1606 is inserted into the handheld wager gaming unit lock box 1600, the door 1602 can close and the key lock 1608 can secure the door 1602 shut. In one embodiment, the door 1602 can include other locking mechanisms, such as combination locks, electronic locks, latches, etc. In one embodiment, the door can automatically open and close in response to electronic signals and/or computer operations.

Example Wager Gaming Machine

This section presents embodiments of an example wager gaming machine.

Figure 17:
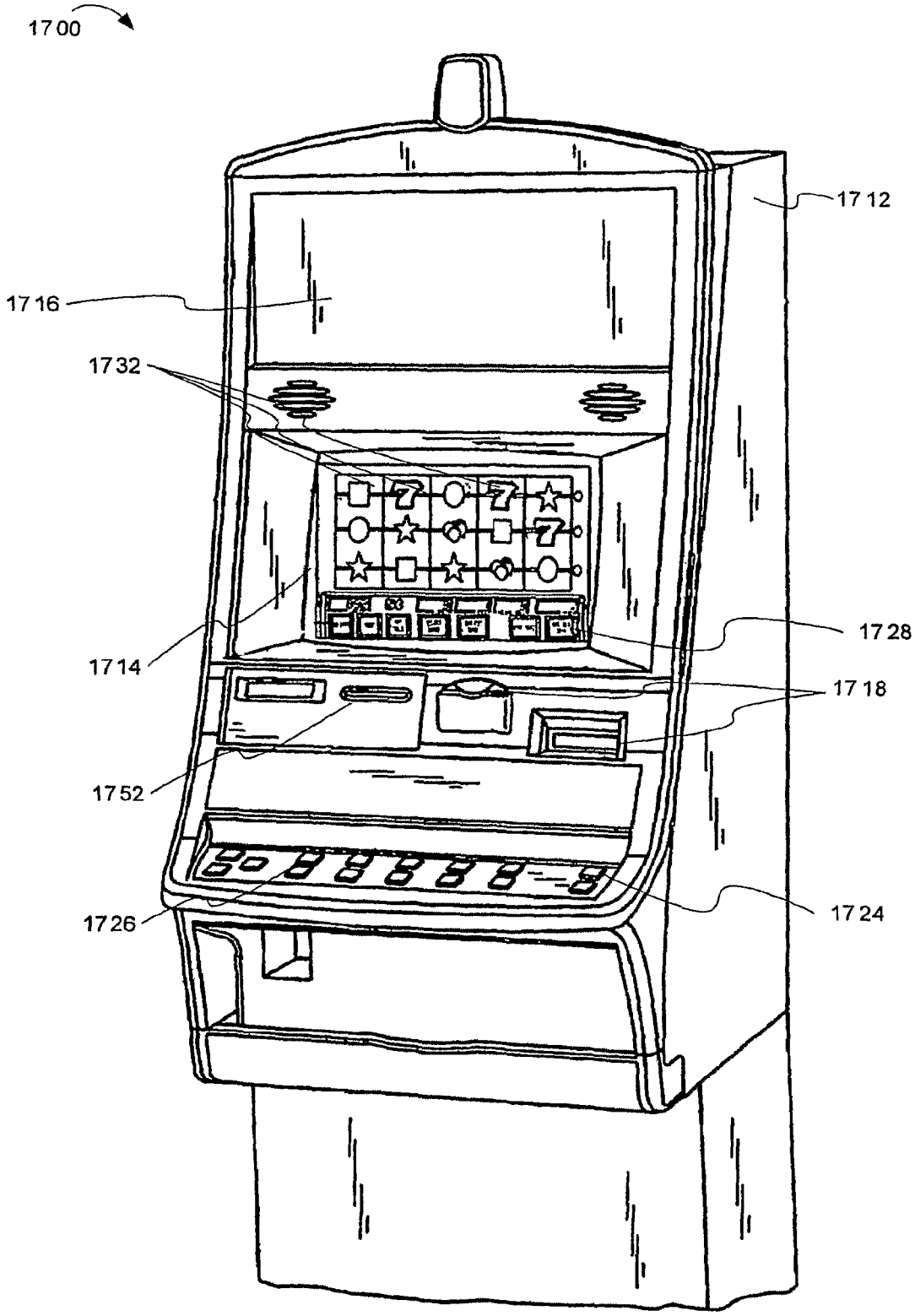
FIG. 17 is a perspective view of a wager gaming machine, according to example embodiments of the invention.

FIG. 17 is a perspective view of a wager gaming machine, according to example embodiments of the invention. Referring to FIG. 17, a wager gaming machine 1700 is used in gaming establishments, such as casinos. According to embodiments, the wager gaming machine 1700 can be any type of wager gaming machine and can have varying structures and methods of operation. For example, the wager gaming machine 1700 can be an electromechanical wager gaming machine configured to play mechanical slots, or it can be an electronic wager gaming machine configured to play video casino games; such as blackjack, slots, keno, poker, blackjack, roulette, etc.

The wager gaming machine 1700 comprises a housing 1712 and includes input devices, including value input devices 1718 and a player input device 1724. For output, the wager gaming machine 1700 includes a primary display 1714 for displaying information about a basic wagering game. The primary display 1714 can also display information about a bonus wagering game and a progressive wagering game. The wager gaming machine 1700 also includes a secondary display 1716 for displaying wagering game events, wagering game outcomes, and/or signage information. While some components of the wager gaming machine 1700 are described herein, numerous other elements can exist and can be used in any number or combination to create varying forms of the wager gaming machine 1700.

The value input devices 1718 can take any suitable form and can be located on the front of the housing 1712. The value input devices 1718 can receive currency and/or credits inserted by a player. The value input devices 1718 can include coin acceptors for receiving coin currency and bill acceptors for receiving paper currency. Furthermore, the value input devices 1718 can include ticket readers or barcode scanners for reading information stored on vouchers, cards, or other tangible portable storage devices. The vouchers or cards can authorize access to central accounts, which can transfer money to the wager gaming machine 1700.

The player input device 1724 comprises a plurality of push buttons on a button panel 1726 for operating the wager gaming machine 1700. In addition, or alternatively, the player input device 1724 can comprise a touch screen 1728 mounted over the primary display 1714 and/or secondary display 1716.

The various components of the wager gaming machine 1700 can be connected directly to, or contained within, the housing 1712. Alternatively, some of the wager gaming machine's components can be located outside of the housing 1712, while being communicatively coupled with the wager gaming machine 1700 using any suitable wired or wireless communication technology.

The operation of the basic wagering game can be displayed to the player on the primary display 1714. The primary display 1714 can also display a bonus game associated with the basic wagering game. The primary display 1714 can include a cathode ray tube (CRT), a high resolution liquid crystal display (LCD), a plasma display, light emitting diodes (LEDs), or any other type of display suitable for use in the wager gaming machine 1700. Alternatively, the primary display 1714 can include a number of mechanical reels to display the outcome. In FIG. 17, the wager gaming machine 1700 is an "upright" version in which the primary display 1714 is oriented vertically relative to the player. Alternatively, the wager gaming machine can be a "slant-top" version in which the primary display 1714 is slanted at about a thirty-degree angle toward the player of the wager gaming machine 1700. In yet another embodiment, the wager gaming machine 1700 can be a bartop model, a mobile handheld model, or a workstation console model.

A player begins playing a basic wagering game by making a wager via the value input device 1718. The player can initiate play by using the player input device's buttons or touch screen 1728. The basic game can include arranging a plurality of symbols along a payline 1732, which indicates one or more outcomes of the basic game. Such outcomes can be randomly selected in response to player input. At least one of the outcomes, which can include any variation or combination of symbols, can trigger a bonus game.

In some embodiments, the wager gaming machine 1700 can also include an information reader 1752, which can include a card reader, ticket reader, bar code scanner, RFID transceiver, or computer readable storage medium interface. In some embodiments, the information reader 1752 can be used to award complimentary services, restore game assets, track player habits, etc.

General

In the detailed description, reference is made to specific examples by way of drawings and illustrations. These examples are described in sufficient detail to enable those skilled in the art to practice the inventive subject matter, and serve to illustrate how the inventive subject matter may be applied to various purposes or embodiments. Other embodiments are included within the inventive subject matter, as logical, mechanical, electrical, and other changes may be made to the example embodiments described herein. Features or limitations of various embodiments described herein, however essential to the example embodiments in which they are incorporated, do not limit the inventive subject matter as a whole, and any reference to the invention, its elements, operation, and application are not limiting as a whole, but serve only to define these example embodiments. The detailed description does not, therefore, limit embodiments of the invention, which are defined only by the appended claims. Each of the embodiments described herein are contemplated as falling within the inventive subject matter, which is set forth in the following claims.

The invention claimed is:

1. A gaming system comprising:

a wagering game controller configured o conduct wagering games upon which monetary value can be wagered:

a community game controller configured to conduct a community game triggered during play of at least one of the wagering games;

a plurality of handheld wagering game units; and a mobile wagering game station including:

a plurality of receptacles configured to removably store at least a portion of the plurality of handheld wagering game units therein, wherein at least a portion of the plurality of receptacles are configured to sanitize the respective handheld wagering game units;

a wireless access point enabling the plurality of handheld wagering game units to wirelessly communicate with the wagering game controller to present the wagering games and to wirelessly communicate with the community game controller to participate in the community game, the wireless access point defining a gaming space where the plurality of handheld wagering game units can present the wagering games; and a mobility member permitting the mobile wagering game station to be moved about a gaming establishment, thereby relocating the gaming space.

2. The gaming system of claim 1, further including a community display connected to the community game controller and configured to present at least a portion of the community game.

3. The gaming system of claim 1, wherein the plurality of receptacles are configured to charge the respective handheld wagering game units.

4. The gaming system of claim 1, wherein the mobile wagering game station is configured to:

receive a check-out request and player identification information from a player;

associate the player identification information with at least one of the handheld wagering game units; and release the at least one handheld wagering game unit to the player.

5. The gaming system of claim 1, wherein the mobility member of the mobile wagering game station includes a plurality of wheels.

6. The gaming system of claim 5, wherein the mobility member of the mobile wagering game station includes a motor.

7. A gaming system comprising:

a wagering game controller configured to conduct wagering games upon which monetary value can be wagered;

a plurality of handheld wagering game units; and a mobile wagering game station including:

a plurality of receptacles configured to removably store at least a portion of the plurality of handheld wagering game units therein, wherein the plurality of receptacles are configured to sanitize the respective handheld wagering game units;

a wireless access point enabling the plurality of handheld wagering game units to wirelessly communicate with the wagering game controller to present the wagering games and to wirelessly communicate with a community game controller to participate in a community game triggered during play of at least one of the wagering games; the wireless access point defining a gaining space where the plurality of handheld wagering game units can present the wagering games; and a mobility member permitting the mobile wagering game station to be moved about a gaming establishment, thereby relocating the gaming space.

8. The gaming system of claim 7, further including a community display connected to the community game controller and configured to present at least a portion of the community game.

9. The gaming system of claim 7, wherein the plurality of receptacles are configured to sanitize the respective handheld wagering game units using an ozone bath.

10. The gaming system of claim 7, wherein the plurality of receptacles are configured to sanitize the respective handheld wagering game units by applying an antimicrobial cleaner.

11. The gaming system of claim 7, wherein the mobile wagering game station is configured to:

receive a check-out request and player identification information from a player;

associate the player identification information with at least one of the handheld wagering game units; and release the at least one handheld wagering game unit to the player.

12. The gaming system of claim 7, wherein the mobility member of the mobile wagering game station includes a plurality of wheels.

13. The gaming system of claim 12, wherein the mobility member of the mobile wagering game station includes a motor.

14. A gaining system comprising:

a wagering game controller configured to conduct wagering games upon which monetary value can be wagered;

a community game controller configured to conduct a community game triggered during play of at least one of the wagering games; and a mobile wagering game station including:

a plurality of receptacles configured to removably store a plurality of handheld wagering game units therein, the plurality of receptacles configured to sanitize the respective handheld wagering game units:

a wireless access point enabling the plurality of handheld wagering game units to wirelessly communicate with the wagering game controller to present the wagering games and to wirelessly communicate with the community game controller to participate in the community game, the wireless access point defining a gaming space where the plurality of handheld wagering game units can present the wagering games; and a mobility member permitting the mobile wagering game station to be moved about a gaming establishment, thereby relocating the gaming space.

15. The gaming system of claim 14, further including a community display connected to the community game controller and configured to present at least a portion of the community game.

16. The gaming system of claim 14, wherein the mobile wagering game station is configured to:

receive a check-out request and player identification information from a player;

associate the player identification information with at least one of the handheld wagering game units; and release the at least one handheld wagering game unit to the player.

17. The gaming system of claim 14, wherein the mobility member of the mobile wagering game station includes a plurality of wheels.

18. The gaming system of claim 17, wherein the mobility member of the mobile wagering game station includes a motor.

* * * * *

UNITED STATES PATENT AND TRADEMARK OFFICE

CERTIFICATE OF CORRECTION

PATENT NO. : 8,371,932 B2
APPLICATION NO. : 12/278617
DATED : February 12, 2013
INVENTOR(S) : Gagner et al.

It is certified that error appears in the above-identified patent and that said Letters Patent is hereby corrected as shown below:

In the Specifications

In column 4, line 34, delete “216” and insert --206--, therefor

In column 4, line 38, delete “218” and insert --216--, therefor

In column 7, line 5, after “and” insert --206 and--, therefor

In column 13, line 34, delete “216” and insert --218--, therefor

In column 13, line 39, delete “barrower” and insert --borrower--, therefor

In column 14, line 39, delete “106” and insert --1106--, therefor

In column 15, line 25, delete “1412” and insert --1414--, therefor

In the Claims

In column 17, line 1, in claim 1, delete “o” and insert --to--, therefor

In column 17, line 51, in claim 1, delete “wagered:” and insert --wagered;--, therefor In column 18, line 43, in claim 7, delete “games;” and insert --games,--, therefor In column 18, line 44, in claim 7, delete “gaining” and insert --gaming--, therefor In column 19, line 7, in claim 14, delete “gaining” and insert --gaming--, therefor In column 19, line 16, in claim 14, delete “units:” and insert --units;--, therefor Signed and Sealed this
Third Day of December, 2013

Margaret A. Focarino

Margaret A. Focarino
*Commissioner for Patents of the United States Patent and Trademark Office*

UNITED STATES PATENT AND TRADEMARK OFFICE

CERTIFICATE OF CORRECTION

PATENT NO. : 8,371,932 B2
APPLICATION NO. : 12/278617
DATED : February 12, 2013
INVENTOR(S) : Gagner et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1196 days.

Signed and Sealed this
First Day of September, 2015

Michelle K. Lee

Michelle K. Lee
*Director of the United States Patent and Trademark Office*